US006516539B2

(12) United States Patent
Nishiwaki et al.

(10) Patent No.: US 6,516,539 B2
(45) Date of Patent: Feb. 11, 2003

(54) SHOCK ABSORBING DEVICE FOR SHOE SOLE

(75) Inventors: Tsuyoshi Nishiwaki, Kobe (JP); Shigeyuki Mitsui, Kobe (JP); Seiichi Ueno, Kobe (JP); Kiyomitsu Kurosaki, Kobe (JP)

(73) Assignee: Asics Corp., Kobe (JP)

( * ) Notice: Subject to any disclaimer, the term of this patent is extended or adjusted under 35 U.S.C. 154(b) by 1 day.

(21) Appl. No.: 09/850,286

(22) Filed: May 7, 2001

(65) Prior Publication Data

US 2001/0052194 A1 Dec. 20, 2001

(30) Foreign Application Priority Data

May 15, 2000 (JP) ..... 2000-141718

(51) Int. Cl.[7] ..... A43B 13/18

(52) U.S. Cl. ..... 36/28; 36/30 R; 36/30 A; 36/72; 36/35 R

(58) Field of Search ..... 36/27, 28, 29, 36/30 R, 30 A, 71, 35 R, 37, 38, 31, 25 R, 92, 87, 88, 102, 103, 36 A, 44, 114, 76 C, 32 R

(56) References Cited

U.S. PATENT DOCUMENTS

| | | | | |
|---|---|---|---|---|
| 3,834,046 A | * | 9/1974 | Fowler | 36/28 |
| 4,733,483 A | | 3/1988 | Lin | |
| 4,768,295 A | | 9/1988 | Ito | |
| 4,798,009 A | | 1/1989 | Colonel et al. | |
| 4,798,010 A | | 1/1989 | Sugiyama | |
| 4,999,931 A | | 3/1991 | Vermeulen | |
| 5,311,674 A | | 5/1994 | Santiyanont et al. | |
| 5,595,003 A | | 1/1997 | Snow | |
| 5,753,061 A | | 5/1998 | Rudy | |
| 5,782,014 A | | 7/1998 | Peterson | |
| 5,815,949 A | | 10/1998 | Sessa | |
| 5,915,819 A | | 6/1999 | Gooding | |
| 5,918,383 A | | 7/1999 | Chee | |
| 5,987,781 A | | 11/1999 | Pavesi et al. | |
| 6,205,681 B1 | | 3/2001 | Kita | |
| 6,289,608 B1 | * | 9/2001 | Kita et al. | 36/28 |
| 6,311,414 B1 | | 11/2001 | Kita | |
| 6,314,664 B1 | * | 11/2001 | Kita et al. | 36/28 |

FOREIGN PATENT DOCUMENTS

| | | |
|---|---|---|
| JP | 6-17504 | 3/1994 |
| JP | 11346803 A | 12/1999 |
| JP | 2000-4905 | 1/2000 |

* cited by examiner

*Primary Examiner*—Mickey Yu
*Assistant Examiner*—Jila M Mohandesi
(74) *Attorney, Agent, or Firm*—Michael E. Zall

(57) ABSTRACT

This invention is directed to a shock absorbing device for a shoe sole providing a lower layer 2 having an upper face 21 and an upper layer 3 having a lower face 30. The two layers 2, 3 are both made of an elastomer. The faces 21, 30 are each formed to have substantially a corrugated section. The corrugated faces 21, 30 each have a plurality of top portions 22, 32, bottom portions 23, 33, and inclined portions 24, 34 joining the top portions 22, 32 and bottom portions 23, 33, with the corrugated faces 21, 30 each being formed from essentially a smooth surface. The corrugated faces 21, 30 mate with each other. The two mating faces 21, 30 are spaced apart from each other at the top portions 22, 32 and/or at the bottom portions 23, 33, with gaps 4 being formed at the spaced-apart portions.

20 Claims, 20 Drawing Sheets

TYPE 1

TYPE 2

TYPE 3

TYPE 4

SHOCK ABSORBING DEVICE FOR SHOE SOLE

BACKGROUND OF THE INVENTION

1. Field of the Invention

The present invention relates generally to a shoe sole, and more particularly, to a shock absorbing device for the shoe sole.

2. Description of the Prior Art

A shoe sole needs cushioning or shock absorbing properties.

The conventional shoe sole typically dissipates and absorbs energy of landing shock, i.e., shock from the foot upon walking through compressive transformation of a shock absorbing device such as a midsole. However, such an energy absorption (loss) relying on only the compressive transformation will not ensure sufficient shock absorbing abilities due to its small amount of energy absorption in general.

On the contrary, increased thickness of the midsole to increase the energy loss may impair shoe sole's lightweight properties and stability.

U.S. Pat. No. 4,798,010 discloses a shock absorbing device as depicted in FIG. 19(*a*).

In this prior art, a midsole 102 is interposed between an outsole 100 and an upper 101. The midsole 102 consists of a flexible elastic member (30 to 50 degrees in hardness) 103 and a rigid elastic member (60 to 80 degrees in hardness) 104 which are joined together via a joint surface 105. The joint surface 105 is corrugated.

Japan Utility Model Laid-open Pub. No. Hei6-17504 discloses a shock absorbing device as depicted in FIG. 19(*b*).

In this prior art, the midsole 102 is fitted with a shock absorbing device 106 having a corrugated section.

In these prior arts, loads from above bring about compressive transformations of the corrugated portions. However, such compressive transformations do not ensure by themselves sufficient shock absorbing properties.

U.S. Pat. No. 5,915,819 discloses a shock absorbing device as depicted in FIGS. 20(*a*) and 20(*b*).

In this prior art, a multiplicity of compressible chambers 202 are formed between a lower sheet-like member 200 and an upper sheet-like member 201. When a weight 203 is applied from above to the sheet-like member 201, the chambers 202 are put in compression, which compression provides a shock absorbing feature.

In this prior art, the upper and lower sheet-like members 200 and 201 are brought into pressure contact with each other at inclined faces 204, causing a slight shearing transformation. The upper and lower members 200 and 201 however involve a multiplicity of sharp edge and shoulder portions (differentiation-impossible points) 205 at which the sectional contour sharply varies. This impairs the continuity of transformation and hence suppresses the energy absorption attributable to the shearing transformation.

Additionally, due to formation of recessed portions 206 in the lower member 200, when the two members 200 and 201 come into pressure contact with each other at the inclined faces 204 as depicted in FIG. 20(*b*), the lower member 200 can deform such that convexed portions 207 of the lower member 200 migrate into the recessed portions 206 reducing support for inclined face 204. This reduces the contact pressure on the inclined faces 204 and impairs the energy absorption abilities attributable to the shearing transformation.

SUMMARY OF THE INVENTION

It is therefore an object of the present invention to provide a novel structure of a shock absorbing device for a shoe sole so as to facilitate the occurrence of a shearing transformation to thereby achieve an improvement in the shock absorbing properties.

In one aspect of the present invention to attain the above object, a shock absorbing device for a shoe sole comprises a lower layer having an upper face and an upper layer having a lower face.

The two layers are both made of an elastomer.

The upper face of the lower layer and the lower face of the upper layer are each formed to have substantially a corrugated section. (Hereinafter referred to the faces formed to have substantially the corrugated section as "corrugated faces").

The corrugated faces each have a plurality of top portions, a plurality of bottom portions, and a plurality of inclined portions joining the top portions and bottom portions, with the corrugated faces each being formed from essentially a smooth and continuous curvilinear surface.

The corrugated upper face and lower face mate with each other.

The two faces mated with each other (two mating faces) are in contact with each other at the inclined portions of the faces.

The two mating faces are spaced apart from each other at the top portions and/or at the bottom portions, with gaps being formed at the spaced-apart portions.

In another aspect of the present invention, a shock absorbing device for a shoe sole comprises a lower layer having an upper face and an upper layer having a lower face.

The two layers are both made of an elastomer.

The upper face of the lower layer and the lower face of the upper layer are each formed to have substantially a corrugated section.

The corrugated faces each have a plurality of top portions, a plurality of bottom portions, and a plurality of inclined portions joining the top portions and bottom portions.

The top portions of the upper face of the lower layer are formed with essentially a recess-free, upwardly convexed surface, the bottom portions of the lower face of the upper layer are formed with essentially a recess-free, downwardly convexed surface.

The corrugated upper face and lower face mate with each other.

The two mating faces are in contact with each other at the inclined portions of the faces.

The two mating faces are spaced apart from each other at the top portions and/or at the bottom portions, with gaps being formed at the spaced-apart portions.

In a further aspect of the present invention, a shock absorbing device for a shoe sole comprises a lower layer having an upper face, an upper layer having a lower face, and an intermediate layer interposed between the lower layer and the upper layer.

The upper face of the lower layer and the lower face of the upper layer are each formed to have substantially a corrugated section.

The corrugated faces each have a plurality of top portions, a plurality of bottom portions, and a plurality of inclined portions joining the top portions and bottom portions.

The corrugated upper face and lower face mate via the intermediate layer with each other.

The two mating faces are in contact via the intermediate layer with each other at the respective inclined portions.

The two mating faces are spaced apart from each other at the top portions and/or at the bottom portions, with gaps being formed at the spaced-apart portions.

According to the present invention, between the upper and lower layers having corrugated sections, gaps are formed at the top portions and/or at the bottom portions of the corrugations. Thus the application of loads from above causes a shearing transformation at the inclined portions in contact with each other, the shearing transformation arising from shearing of textures of the inclined portions along the inclined surfaces. Thus, the loads from above presents not merely the compressive transformation but also a shearing transformation which contributes to an improvement of the shock absorbing properties.

In the present invention, the corrugated faces are each formed from essentially a smooth and continuous curvilinear surface so that there exist no sharply varying points in the sectional contours, whereupon there will occur a shearing transformation not merely at the textures of the inclined portions but also at the top portions and bottom portions without impairing the continuity in the shearing transformation. Remarkably improved shock absorbing properties are thus achieved.

As used herein, "the corrugated faces are each formed from essentially a smooth and continuous curvilinear surface" means that the sectional contours include a contour consisting of a curve and a curve which are smoothly joined together and a contour consisting of a curve and a straight line which are smoothly joined together and that there exist a plurality of crests and troughs having no sharply varying points which make the differentiation thereat difficult.

In the present invention, on the other hand, the top portions of the upper face of the lower layer are formed with essentially a recess-free upwardly convexed surface, and the bottom portions of the lower face of the upper layer are formed with essentially a recess-free downwardly convexed surface. Thus, when the upper layer and the lower layer come into direct or indirect pressure contact with each other, the textures do not migrate into the top portions or bottom portions forming the convexed surfaces, thus adding to the contact pressure on the inclined portions. This results in an increased energy absorption capability attributable to the shearing transformation.

As used herein, "essentially a recess-free" means that there exist a plurality of top portions of upper face and bottom portions of lower face which are not recessed.

In the present invention, it is preferred that at least four crests and troughs mating each other are arranged in lattice points of a substantially plane lattice in the upper layer and the lower layer. Upon walking or running, the foot tends to land from lateral side to medial side and from rear to front, downward from diagonally above. In this manner, the landing shock has a directionality, and since the direction varies depending on the weight shifting after landing (the foot lands at the rear lateral side of the heel portion and thereafter the trajectory of the center of gravity varies as a function of the weight shifting), the arrangement of the crests and troughs in lattice points of a substantially plane lattice enables the shock that occurs upon landing to be relieved.

Furthermore, by virtue of the mutual separations of the two corrugated faces at their top portions and bottom portions, the upper layer and the lower layer textures can migrate diagonally downward, facilitating the shearing transformation, which contributes to a further improved cushioning.

DESCRIPTION OF THE PREFERRED EMBODIMENTS

Figure 1A:
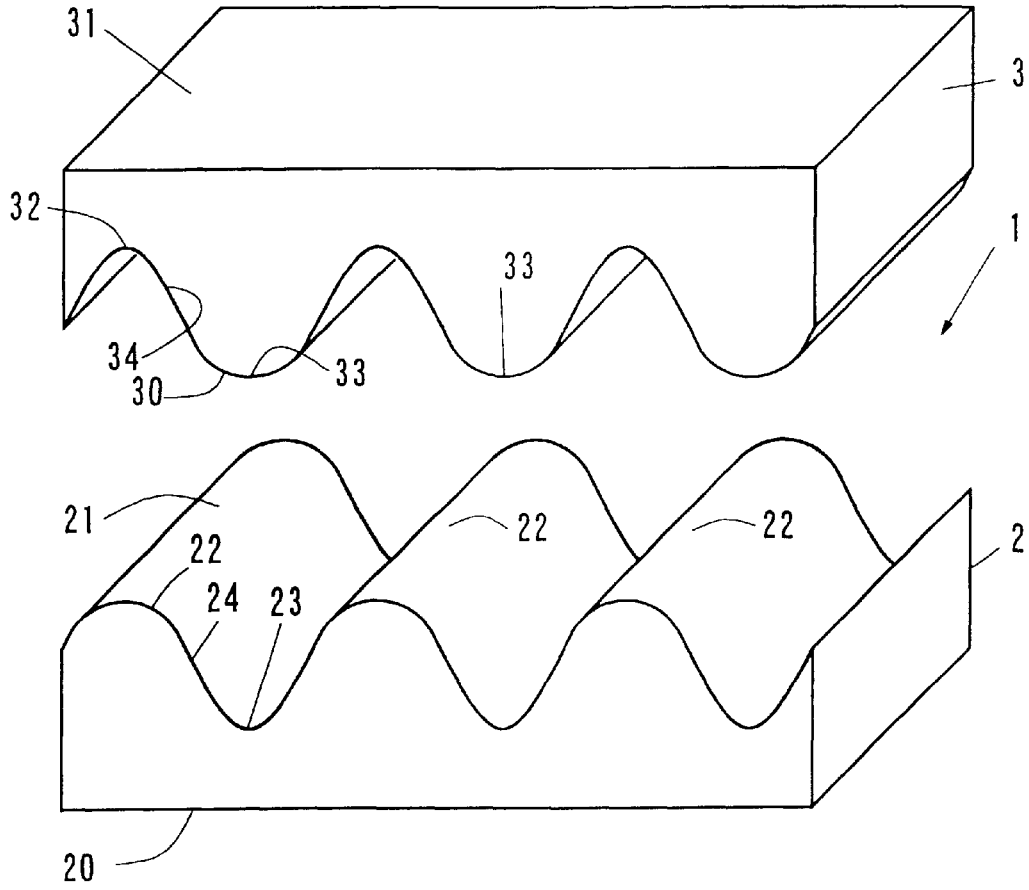
FIG. 1(*a*) is an exploded perspective view of a shock absorbing device for a shoe sole, showing a first embodiment based on the principle of the present invention, and FIG. 1(*b*) is a longitudinal sectional view of the same.

The present invention will clearly be understood from the following description of the preferred embodiments with reference to the accompanying drawings. It is to be noted however that the embodiments and drawings are merely for illustrative and descriptive purposes. The scope of the present invention is defined by the appended claims. In the annexed drawings, like reference numerals designate like or corresponding parts throughout several views.

Principled First Embodiment

The basic structure and principle of the present invention will now be described in accordance with a first embodiment of FIGS. 1 to 3.

Figure 1B:
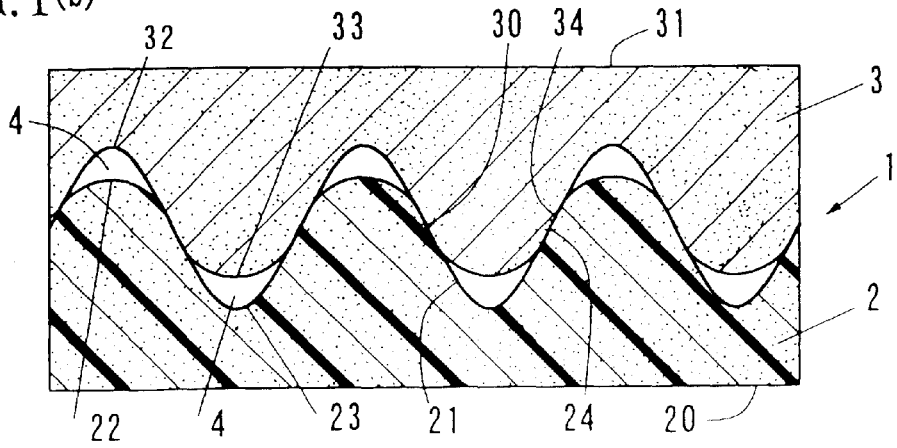
Figure 2A:
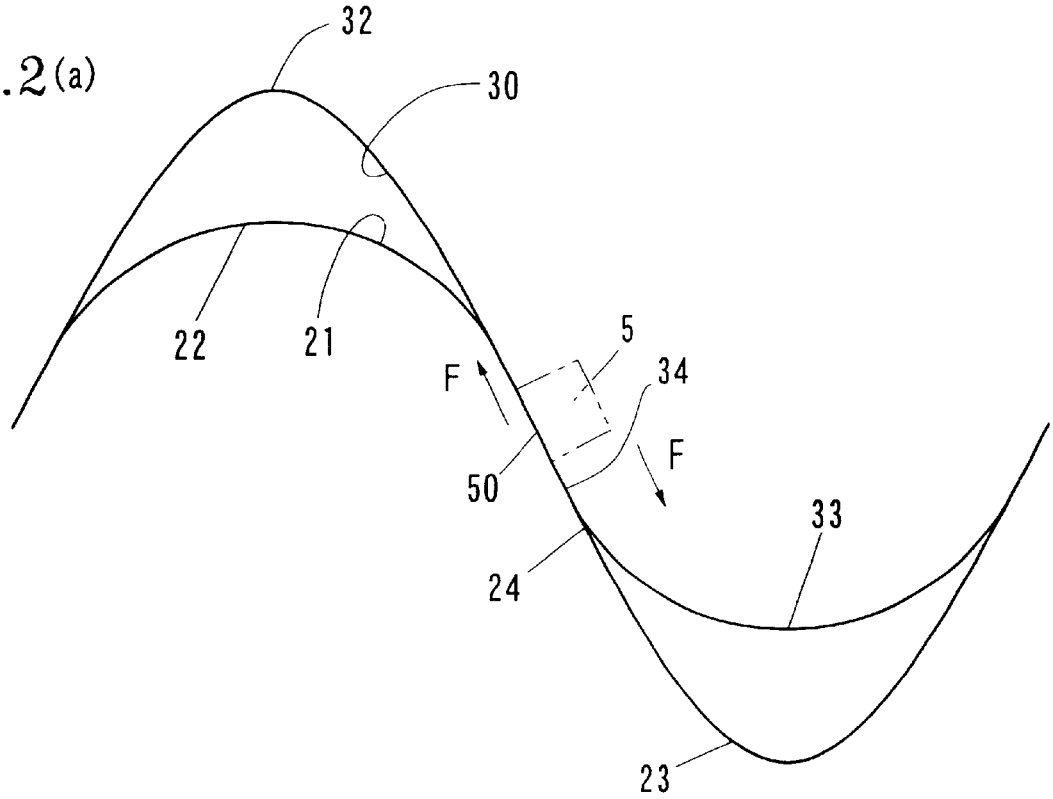
FIG. 2(*a*) is an enlarged diagrammatic representation for explaining the principle of the invention, FIG. 2(*b*) is an enlarged diagrammatic representation showing the state of shearing transformation, and FIG. 2(*c*) is an enlarged diagrammatic representation showing the state of compressive transformation.
Figure 2B:
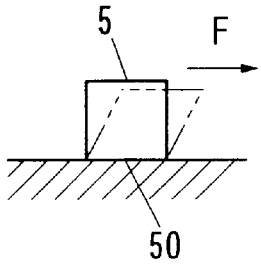
Figure 2C:
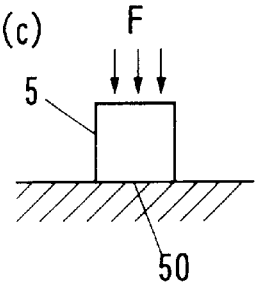

In FIG. 1(*a*), a shock absorbing device 1 is provided with a lower layer 2 and an upper layer 3 which are both made of an elastomer.

The lower layer 2 and the upper layer 3 have respective lower faces 20 and 30 and respective upper faces 21 and 31. The upper face 21 of the lower layer 2 and the lower face 30 of the upper layer 3 are each generally corrugated in sectional configuration. The corrugated faces 21 and 30 each include a plurality of top portions 22 and 32, a plurality of bottom portions 23 and 33, and a plurality of inclined portions 24 and 34 joining the top portions 22 and 32 and the bottom portions 23 and 33, with each corrugated face being formed with essentially a smooth and continuous surface, preferably a curvilinear smooth surface.

As depicted in FIG. 1(*b*), the corrugated upper face 21 and lower face 30 mate with each other. The mating two faces 21 and 30 are in contact with each other at the inclined portions 24 and 34 of the faces. The mating two faces 21 and 30 are spaced apart from each other via spaced-apart portions defined by the two faces 21, 30 both at the top portions 22, 32 and the bottom portions 23, 33, with gaps 4 being formed at the spaced-apart portions.

In FIG. 1(*b*), when a load is now applied from above, the elastomer making up the lower layer 2 and the upper layer 3 are compressed above and below, while simultaneously an imaginary rectangular parallelepiped 5 indicated by a chain double-dashed line of FIG. 2(*a*) attempts to move diagonally downward, with the result that a face 50 of the rectangular parallelepiped 5 is subjected to a diagonally upward frictional force. That is, a diagonally downward moving force F and a diagonally upward frictional force F act cooperatively on the rectangular parallelepiped 5 such that the shearing transformation takes place as indicated by the chain double-dashed line of FIG. 2(*b*). The absorption energy Ug arising from the shearing transformation as shown in FIG. 2(*b*) is far greater than absorption energy Ue arising from the compressive transformation as shown in FIG. 2(*c*).

This will be described in detail.

The energies Ug and Ue are given by the following expressions (1) and (2).

$$Ug=G\gamma^2/2 \quad (1)$$

$$Ue=E\epsilon^2/2 \quad (2)$$

G: coefficient of elasticity in shear

E: coefficient of longitudinal elasticity (Young's modulus)

$\gamma$: shearing strain $\epsilon$: longitudinal strain

On the other hand, load per unit area is $F=E\cdot\epsilon$, $F=G\cdot\gamma$ ($F=E\cdot\epsilon=G\cdot\gamma$), and hence the expressions (1) and (2) are given as follows.

$$Ug=F\cdot\gamma/2 \quad (11)$$

$$Ue=F\cdot\epsilon/2 \quad (12)$$

In the expressions (11) and (12), the shearing strain $\gamma$ is far greater than the longitudinal strain $\epsilon$, that is, the coefficient of longitudinal elasticity E is far greater than the coefficient of elasticity in shear G, and hence the absorption energy Ug arising from the shearing transformation becomes far greater than the absorption energy Ue arising from the compressive transformation.

Figure 3A:
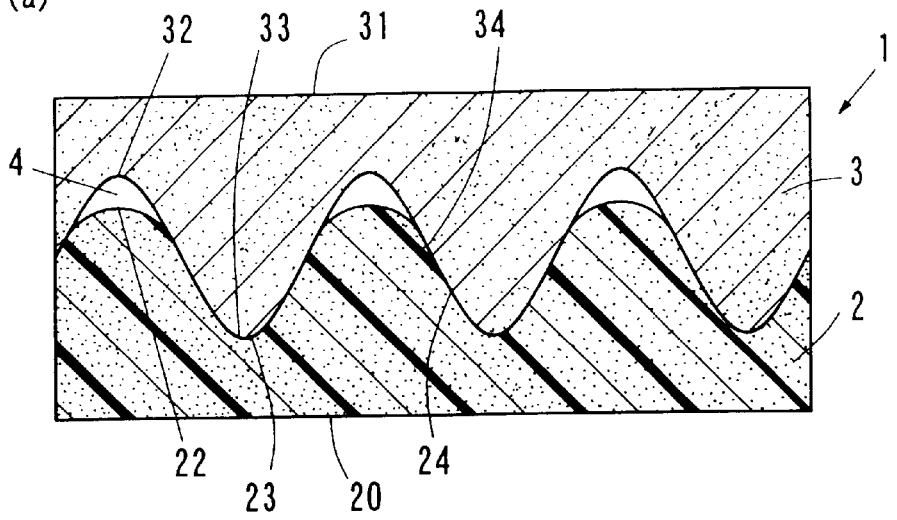
FIG. 3(*a*) and FIG. 3(*b*) are longitudinal sectional views each showing a variant of the embodiment based on the principle, and FIG. 3(*c*) is a chart showing the relationship between SRIS-C hardness and ASTM-B hardness.
Figure 3B:
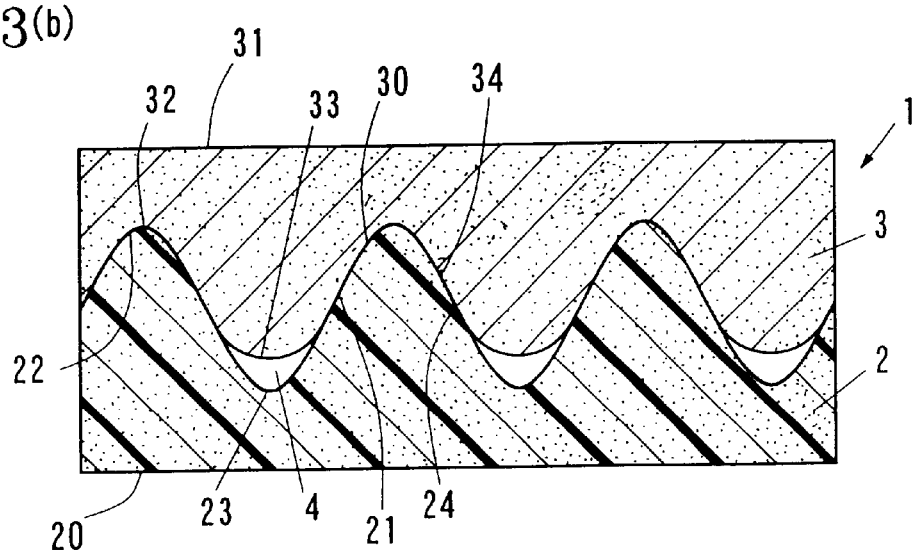
Figure 3C:
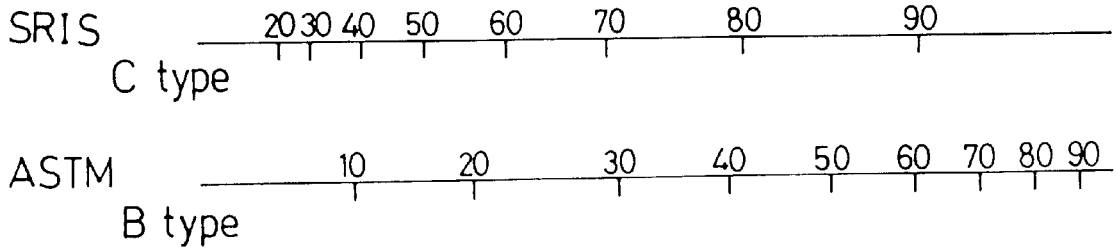

As seen in FIGS. 3(*a*) and 3(*b*), the gaps 4 may be provided at the top portions 22 and 32 and/or at the bottom portions 23 and 33. It is however preferable to form the gaps 4 both at the top portions 22, 32 and at the bottom portions 23, 33 to ease the shearing transformation as depicted in FIG. 1.

The upper layer 3 and the lower layer 2 are preferably made of materials having differing Young's modulus. The layers 2, 3 should differ by 2 degrees or more in SRIS-C hardness (a value measured by a C-type hardness meter of Society of Rubber Industry, Japan Standard) from each other. For example, the lower layer 2 can be formed to have an SRIS-C hardness of between 40 degrees and 80 degrees, more preferably the order of between 50 and 70 degrees, whereas the upper layer 3 can be formed to have an SRIS-C hardness of 35 degrees or less, more preferably between 10 and 30 degrees.

FIG. 3(*c*) shows the relationship between the SRIS-C hardness and ASTM-B hardness. Note that FIG. 3(*c*) provides a mere standard for the comparison of hardness and that it is not to be used for the conversion of hardness. The reason is that the relationship between hardness values obtained by the different type of hardness meters may vary depending on various conditions such as compositions of materials and viscoelasticity determined thereby, dimensions and shape, and further temperature and humidity upon the measurement. The materials having such hardness can include foams of rubber or resin such as EVA (ethylene-vinyl acetate copolymer), syndiotactic 1,2-polybutadiene, etc., for the formation of the lower layer 2, and include a low-hardness elastomer for the formation of the upper layer 3. The low-hardness elastomer is typically silicone gel but may be an elastomer composed mainly of polyethylene and polystyrene (e.g., see Japan Patent Laid-open Pub. No. Hei10-215,909).

In order to increase energy absorption based on the shearing transformation, the angle $\theta$ of the inclined portions 24 and 34 is preferably set between about 30 and 70 degrees, and it most preferably about an angle of 45 degrees.

Principled Second Embodiment

A second embodiment is described herein.

Figure 4:
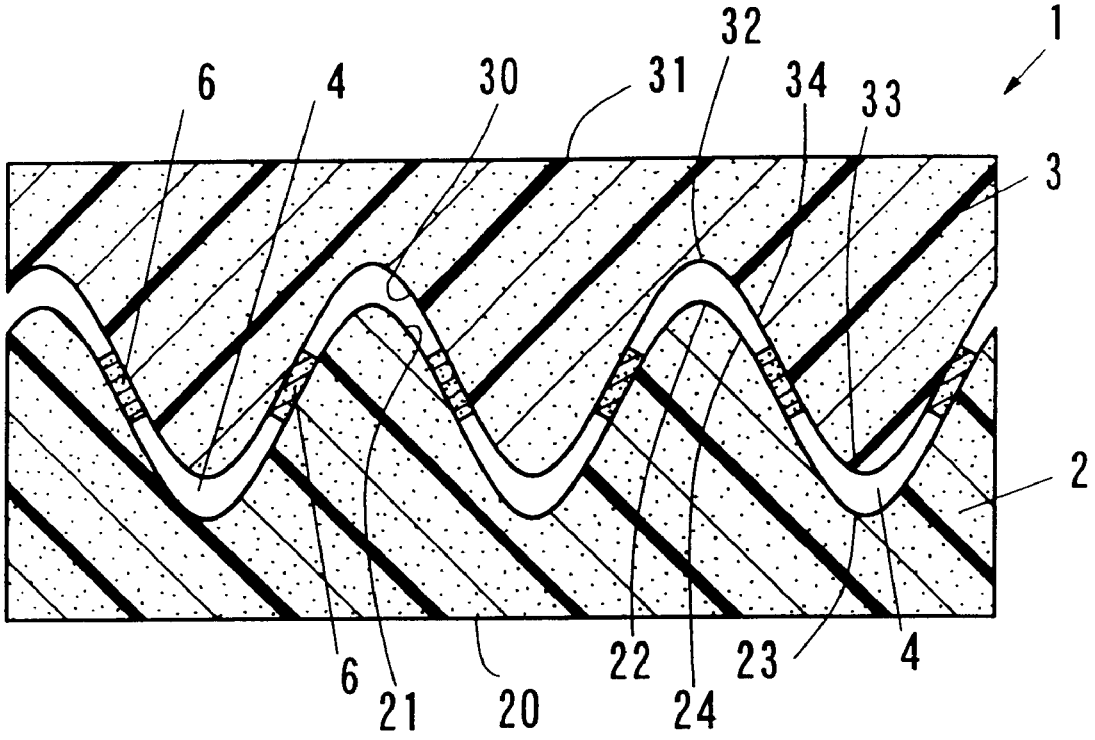
FIG. 4 is a longitudinal sectional view of a shock absorbing device for a shoe sole, showing a second embodiment based on the principle of the present invention.

In FIG. 4, the shock absorbing device 1 is provided with the lower layer 2, the upper layer 3 and an intermediate layer 6, each layer being made of an elastomer.

The lower layer 2 includes the lower face 20 and the upper face 21. The upper layer 3 includes the lower face 30 and the upper face 31 which are different from the lower face 20 and the upper face 21 of the lower layer 2. The intermediate layer 6 intervenes between the two layers 2 and 3.

The upper face 21 of the lower layer 2 and the lower face 30 of the upper layer 3 are each generally corrugated in section. The corrugated faces each have the plurality of top portions 22 and 32, the plurality of bottom portions 23 and 33 and the plurality of inclined portions 24 and 34 joining the top portions 22 and 32 and the bottom portions 23 and 33.

The corrugated upper face 21 and lower face 30 mate via the intermediate layer 6 with each other.

The mating two faces 21 and 30 are each in contact with the intermediate layer 6 at the inclined portions 24 and 34. The mating two faces 21 and 30 are spaced apart from each other both at the top portions 22, 32 and at the bottom portions 23, 33, with the gaps 4 being formed at the spaced-apart portions.

The gaps 4 may be formed at the top portions 22, 32 and/or at the bottom portions 23, 33.

In the present invention, it is preferred that the hardness of the intermediate layer 6 be set to a value which is at least 2 degrees smaller in SRIS-C hardness than the hardness of the upper layer 3 and that the hardness of the intermediate layer 6 be set to a value which is at least 2 degrees smaller in SRIS-C hardness than the hardness of the lower layer 2. For example, the lower layer 2 and the upper layer 3 are formed to have an SRIS-C hardness of between 40 degrees and 80 degrees, preferably about 50 to 70 degrees and the intermediate layer 6 is formed to have an SRIS-C hardness of about 35 degrees or less, preferably between about 10 to 30 degrees. The materials (ingredients) having such hardness can include foams of rubber or resin such as EVA (ethylene-vinyl acetate copolymer) for the formation of the lower layer 2 and the upper layer 3, and include silicone gel for the intermediate layer 6.

Specific First Embodiment

A specific first embodiment of the present invention is described with reference to FIGS. 5 to 7.

Figure 5:
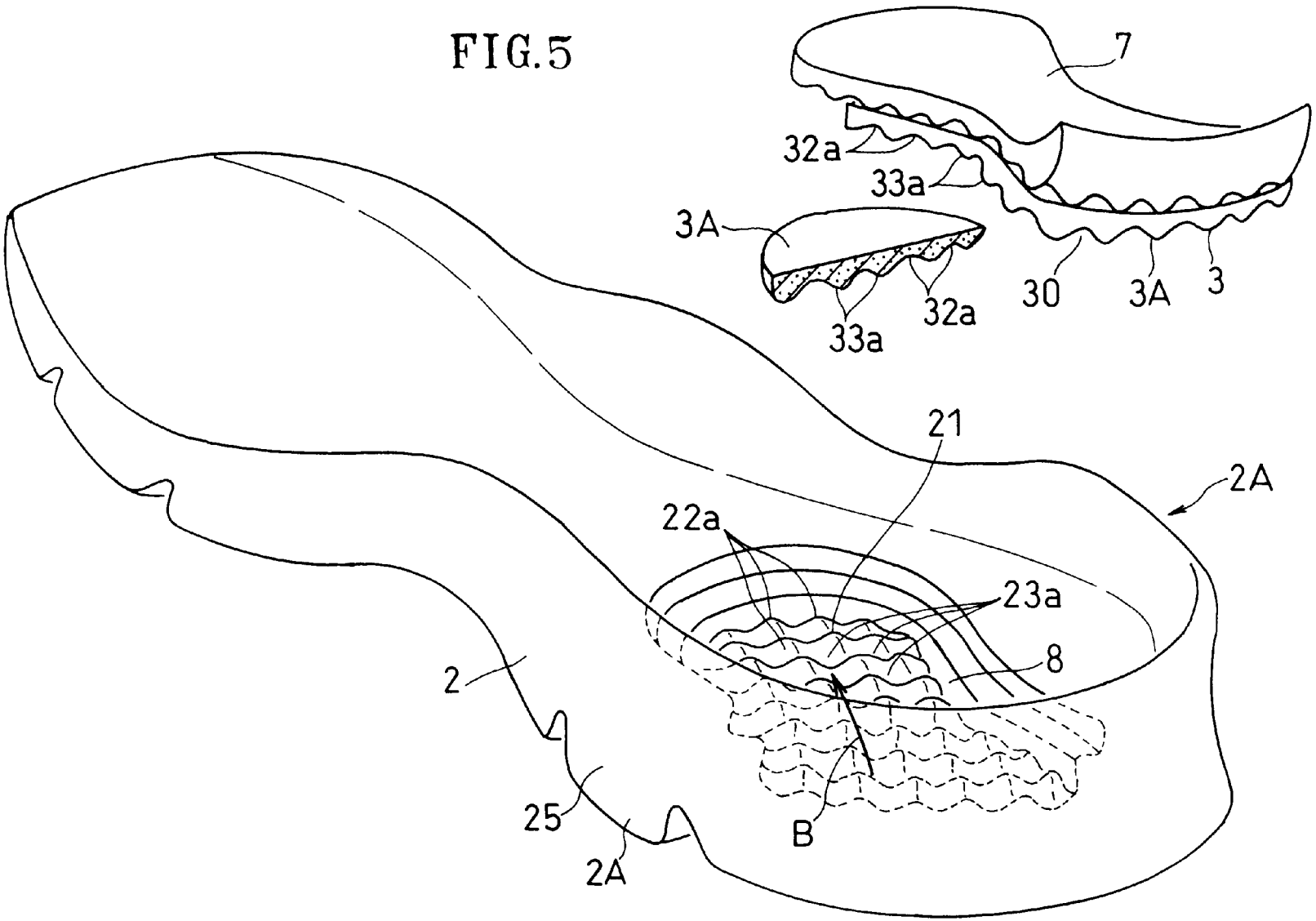
FIG. 5 is an exploded perspective view of a midsole showing a specific first embodiment, with its upper layer being partly cut away.

In FIG. 5, a midsole body 2A is made of, e.g., a foam resin such as EVA and has a loading (mounting) depression 8 formed at its rear foot portion 25. A flexible cushion 3A and a cap 7 are loaded into the loading depression 8. That is, the loading depression 8 is mounted with the flexible cushion 3A and the cap 7. As seen in FIG. 6, the rear foot portion 25 of the midsole body 2A forms the lower layer 2 of this shock absorbing device 1. The flexible cushion 3A is made of, e.g., silicone gel and forms the upper layer 3 of the shock absorbing device 1.

As depicted in FIG. 5, the upper face 21 of the lower layer 2 and the lower face 30 of the upper layer 3 are corrugated in section in the direction where the two faces cross (e.g., orthogonally intersect). More specifically, the upper face 21 of the lower layer 2 has a multiplicity of crests 22*a* and troughs 23*a* which are arranged in lattice points of a substantially planar lattice. The lower face 30 of the upper layer 3 has a multiplicity of troughs 32*a* and crests 33*a* which are arranged in lattice points of a substantially planar lattice. As shown in FIG. 7, the crests 22*a* and 33*a* fit in the troughs 32*a* and 23*a*.

Figure 6:
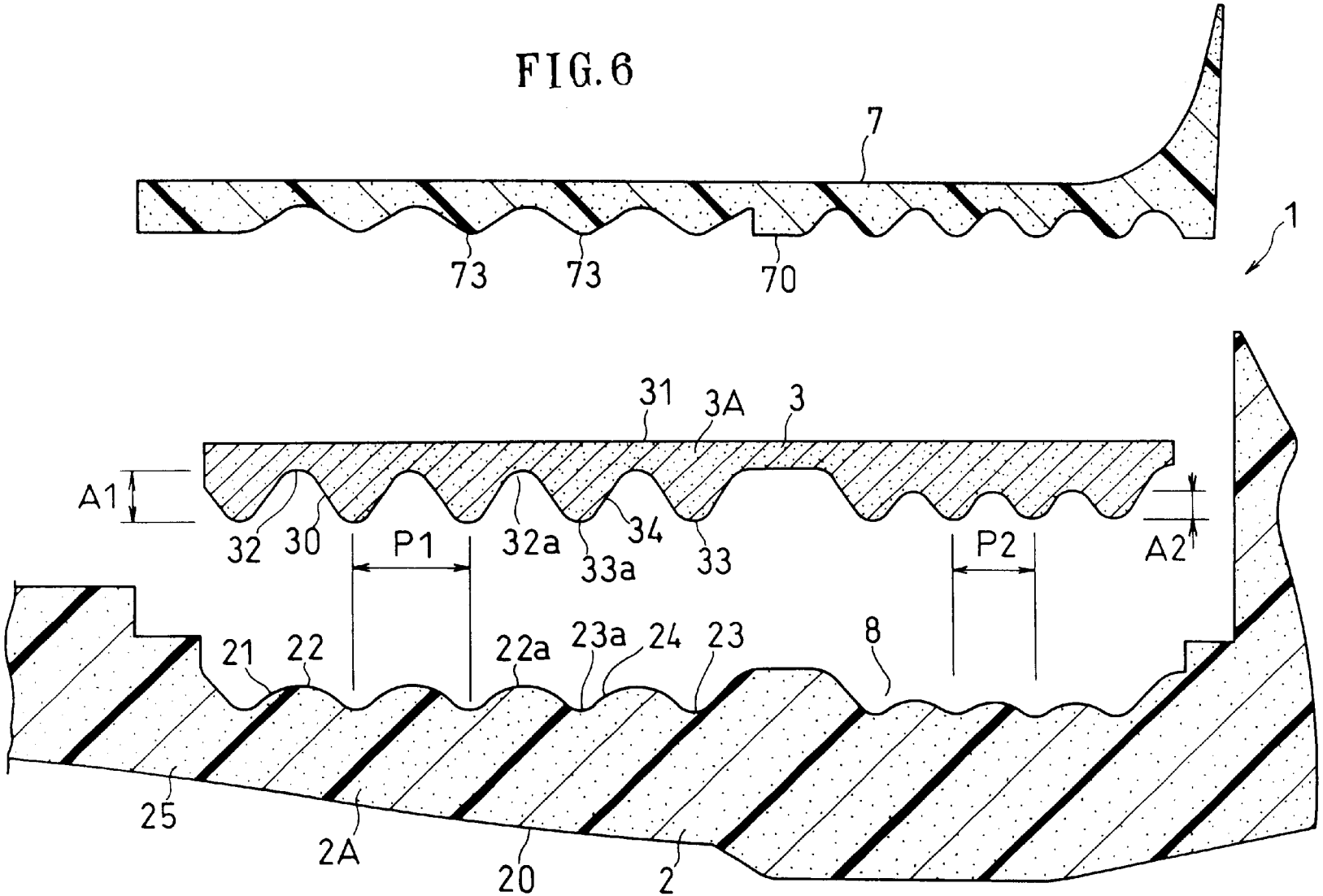
FIG. 6 is an exploded longitudinal sectional view of the same.

As seen in FIG. 6, the corrugations of the lower layer 2 and upper layer 3 each have an equal pitch P1 between the fitting portions. However, in the corrugation of the lower layer 2 or the upper layer 3, pitches P1 and P2 need not be uniform over the layer. The pitches P1 and P2 are set typically at 3 mm or more, preferably 6 mm or more, but less than 30 mm. Amplitudes A1 and A2 of the corrugations need not be uniform over the layer. The larger the amplitudes A1 and A2 are, the higher the cushioning becomes, whereas the smaller the amplitudes A1 and A2 are, the higher the stability becomes.

The cap 7 has a lower face 70 which is also generally corrugated in section. The irregularities of the cap 7 conform to the irregularities of the corrugations of the flexible cushion 3A below. That is, the lower face 70 of the cap 7 has a multiplicity of crests (convex portions) 73 which are arranged in lattice points of a substantially plane lattice in the same manner as the flexible cushion 3A, with the crests 73 being arranged corresponding in position to the bottom portions 33 of the upper layer 3 as shown in FIG. 7. This facilitates the compression of the crests 33*a* of the upper layer 3 relative to the midsole body 2A.

The cap 7 is made of the same material as the midsole body 2A, i.e., EVA having substantially the same hardness as the midsole body 2A, and serves to plug up (close) the loading depressions 8.

As shown in FIG. 5, it is preferred that the plane configuration and the direction for forming corrugations of the shock absorbing device 1 are set along the direction indicated by an arrow B where the foot is disengaged from the ground after landing. Below the midsole body 2A there is provided an outsole (not shown) having a tread face.

Specific Second Embodiment

Figure 8A:
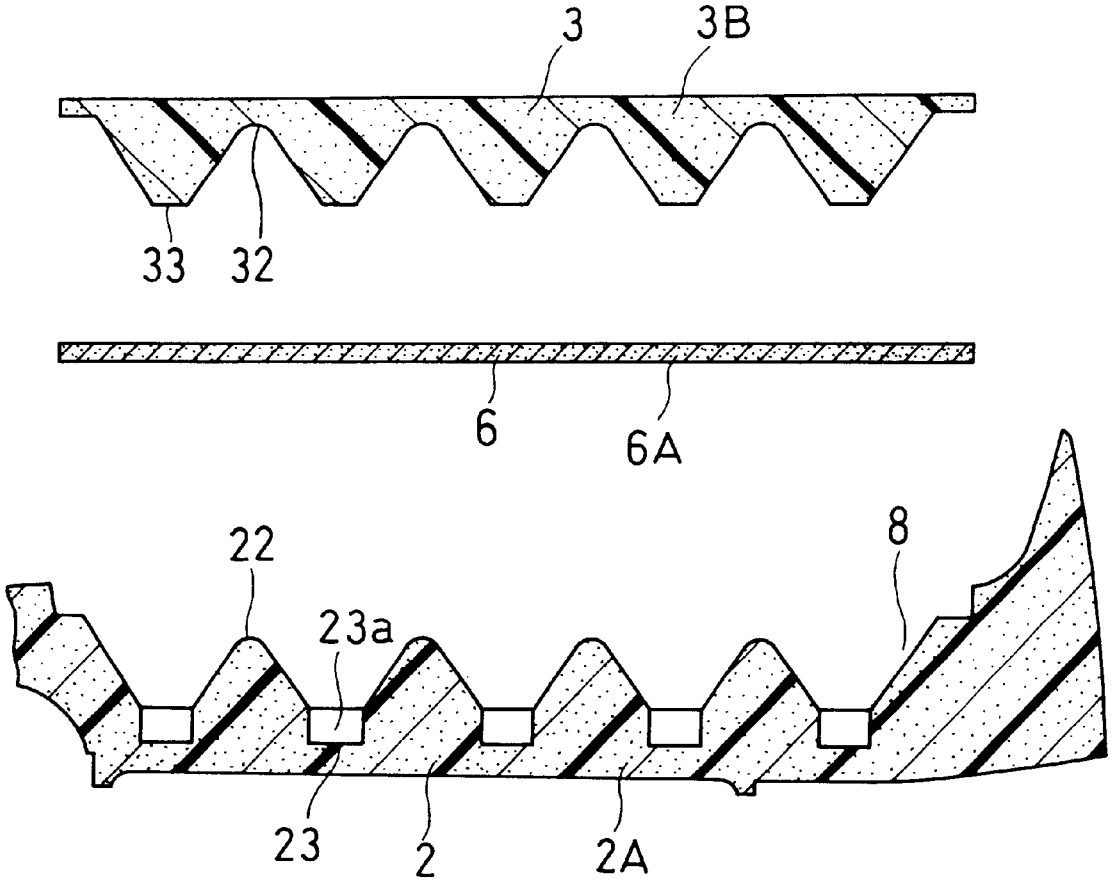
FIG. 8(*a*) is an exploded longitudinal sectional view of a midsole showing a specific second embodiment, and FIG. 8(*b*) is a longitudinal sectional view of the same.
Figure 8B:
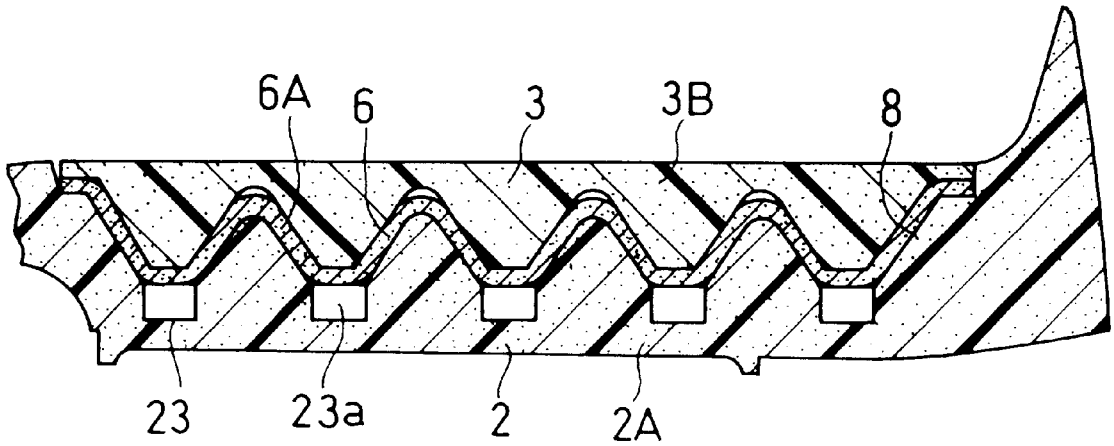

Referring to FIG. 8(*a*), a cap 3B made of EVA is the upper layer 3 in this embodiment. A thick film 6A provides the intermediate layer 6. The film 6A is made of silicone gel and located between the midsole body 2A and the cap 3B. In the midsole body 2A, which is the lower layer 2, small recesses 23*a* are formed on the corrugated bottom portions 23. As seen in FIG. 8(*b*), the cap 3B plugs up (conforms to) the loading depression 8.

Figure 7:
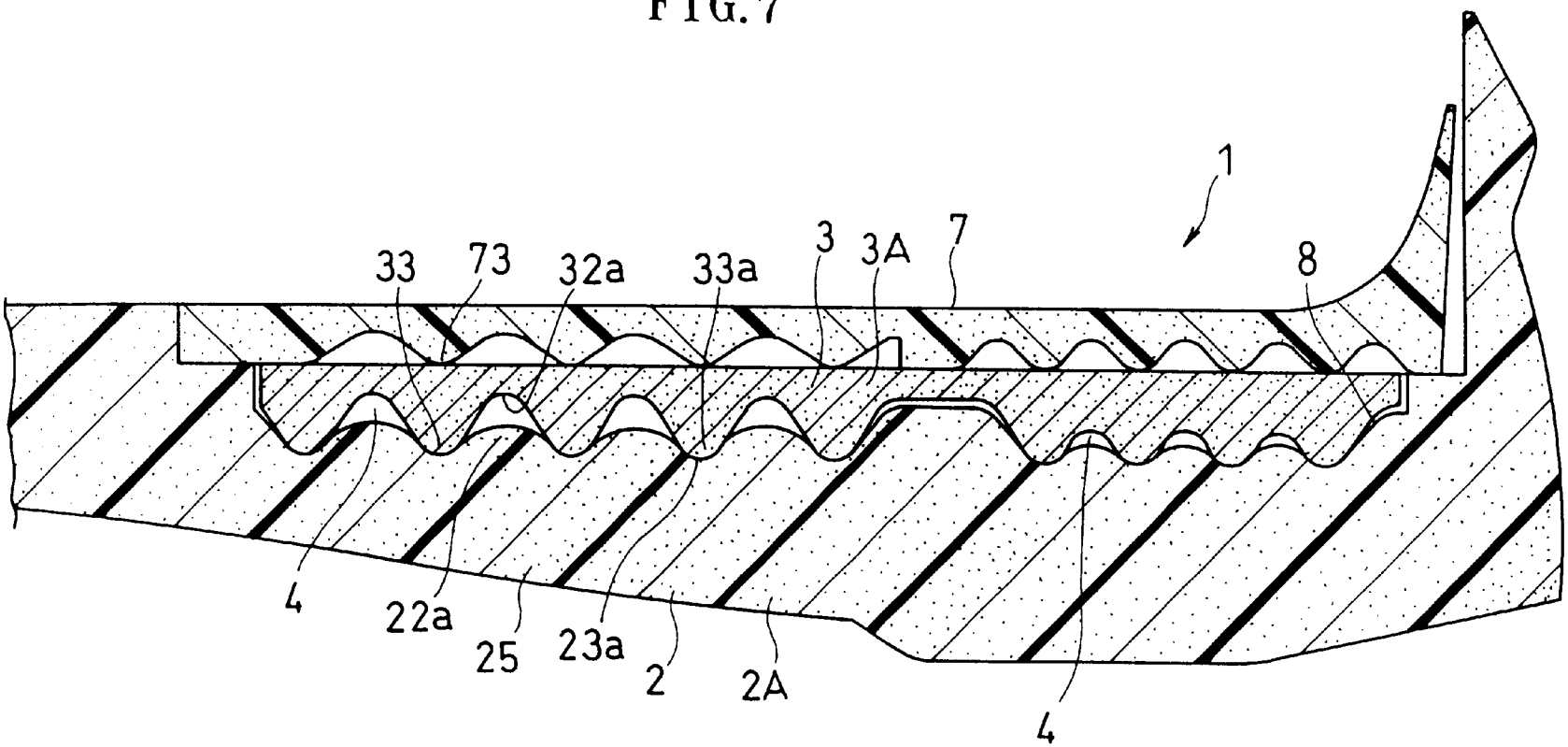
FIG. 7 is a longitudinal sectional view of the same.

The other configurations are similar to the principled second embodiment and to the specific first embodiment of FIGS. 5 to 7, and like reference numerals are given to like or corresponding parts and the detailed description thereof will be omitted.

Figure 9:
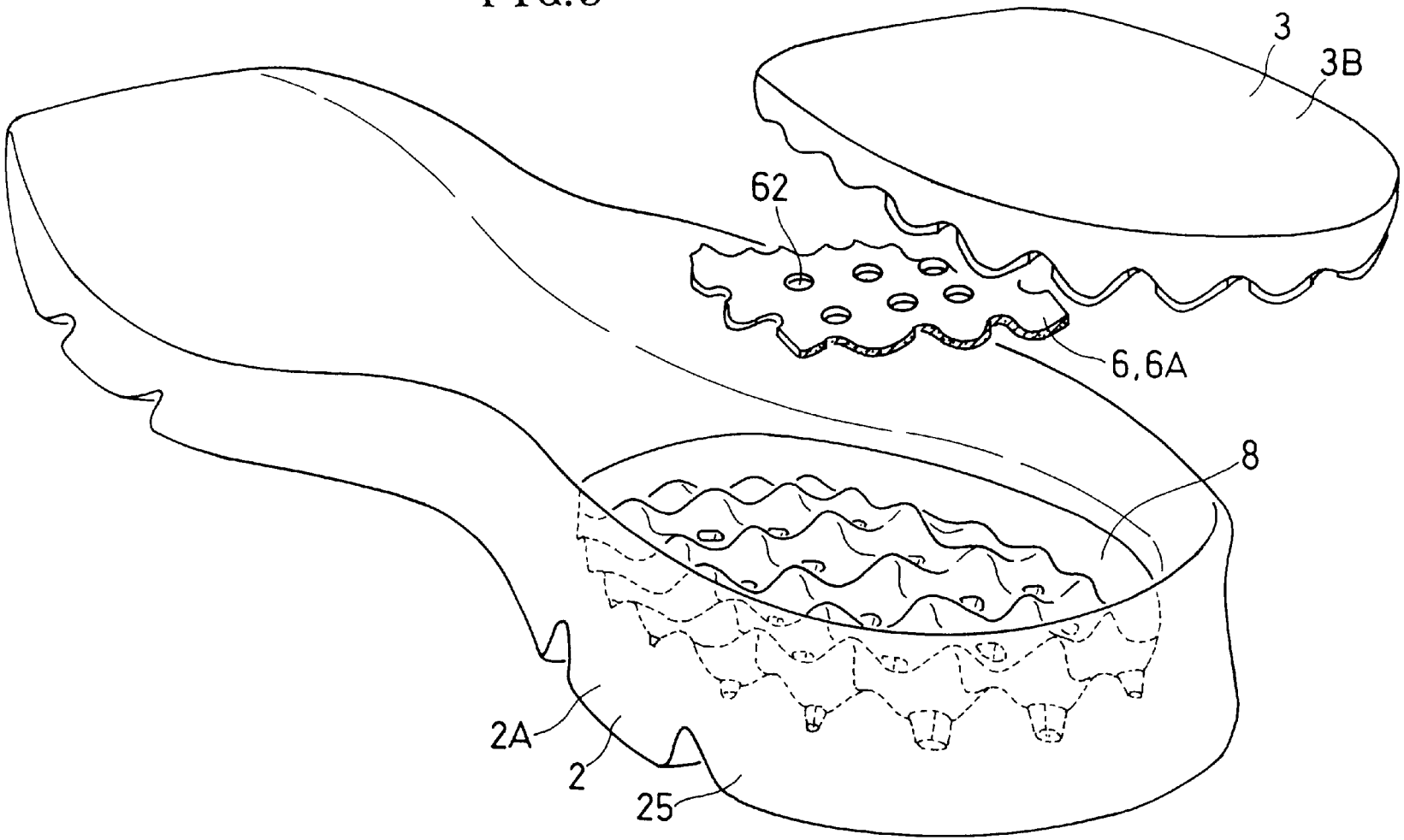
FIG. 9 is an exploded perspective view of a midsole showing a variant of the specific second embodiment, with its intermediate layer being partly cut away.

In the embodiment shown in FIGS. 8(*a*) and 8(*b*), the film 6A may be molded as depicted in FIG. 9. Making detailed description of the film 6A of FIG. 9, the film 6A is molded into a corrugated form conforming to the corrugations of the lower layer 2 and the upper layer 3 and has circularly notched portions 62 which correspond to the top portions of the corrugations. This allows a formation of the gaps 4 both at the top portions 22, 32 and at the bottom portions 23, 33 of the corrugations as seen in FIG. 4.

Specific Third Embodiment

Figure 10:
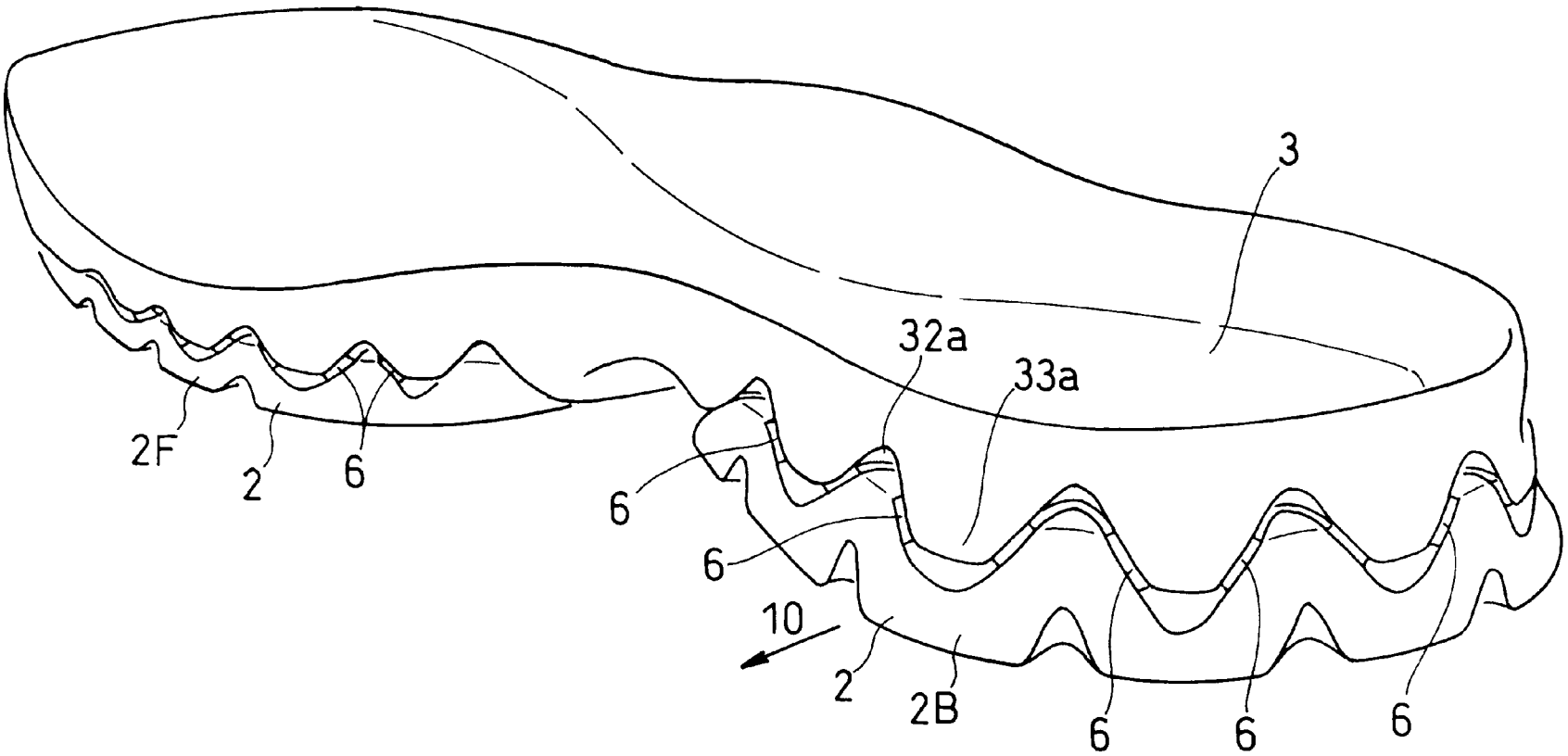
FIG. 10 is a perspective view showing a specific third embodiment.

Referring to FIG. 10, in this embodiment, the upper layer 3 is made up of an upper midsole body, whereas the lower layer 2 is made up of front and rear lower midsole bodies 2F and 2B. The intermediate layer 6 is formed of silicone gel fragments.

Figure 11A:
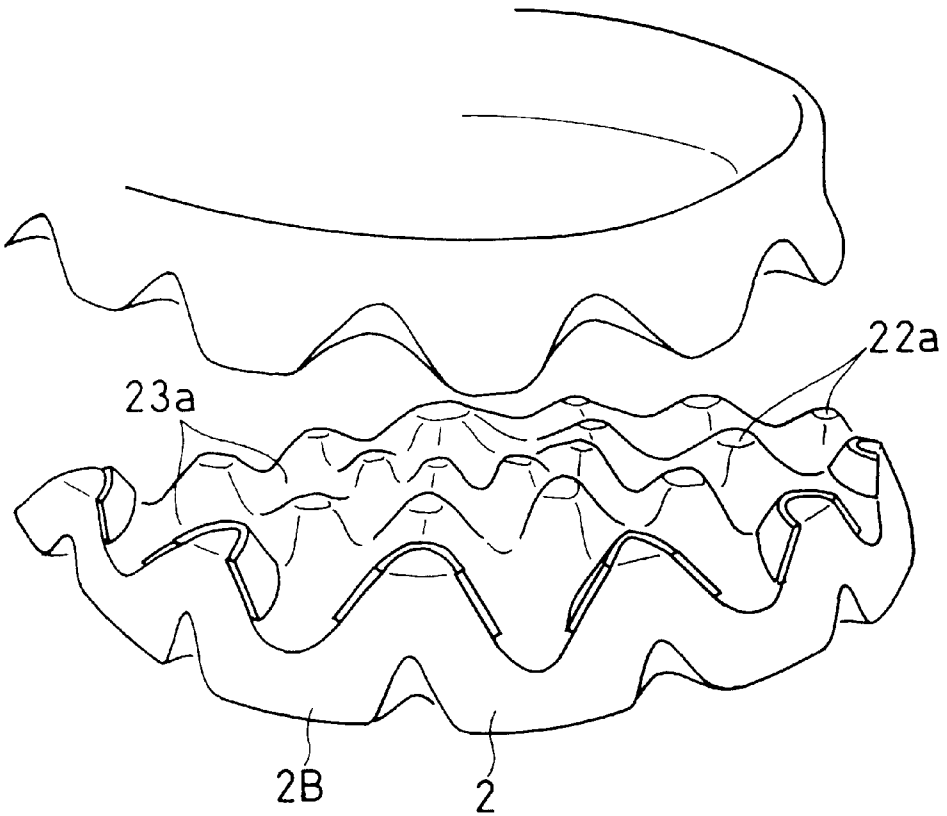
FIG. 11(*a*) is an exploded perspective view of the rear foot portion of the same, and FIG. 11(*b*) is a perspective view of the rear foot portion viewed from medial side.
Figure 11B:
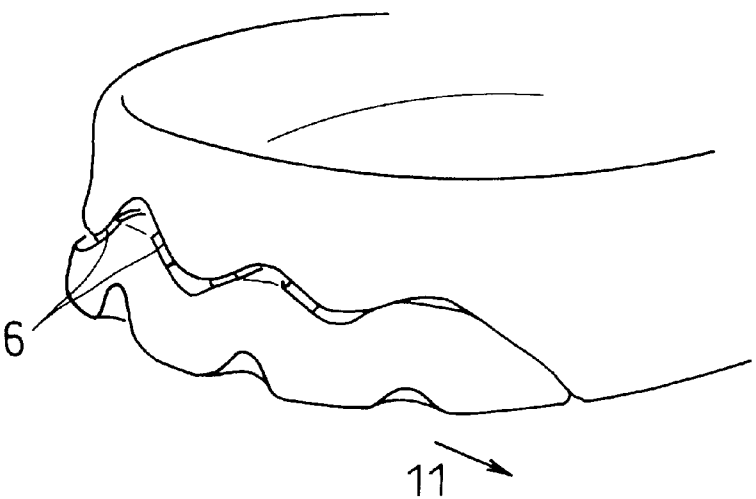

As seen in FIG. 11(*a*), the rear lower midsole body 2B has a multiplicity of crests 22*a* and troughs 23*a* which are arranged in lattice points of a substantially plane lattice. As shown in FIG. 10, the front lower midsole body 2F also has a multiplicity of crests 22*a* and troughs 23*a* which are arranged in lattice points of a substantially plane lattice. The upper midsole body 3 is provided with troughs 32*a* and crests 33*a* which fit in the crests 22*a* and the troughs 23*a*.

As shown in FIGS. 11(*a*) and 11(*b*), the intermediate layer 6 is provided only at the periphery of the midsole. The amplitude of the corrugations is set to a larger value at the lateral side 10 of the foot of FIG. 10 than at the medial side 11 of the foot of FIG. 11(*b*). The reason of such setting lies in that the cushioning is important at the lateral side of the foot and that the stability is required at the medial side of the foot.

Specific Fourth Embodiment

Figure 12:
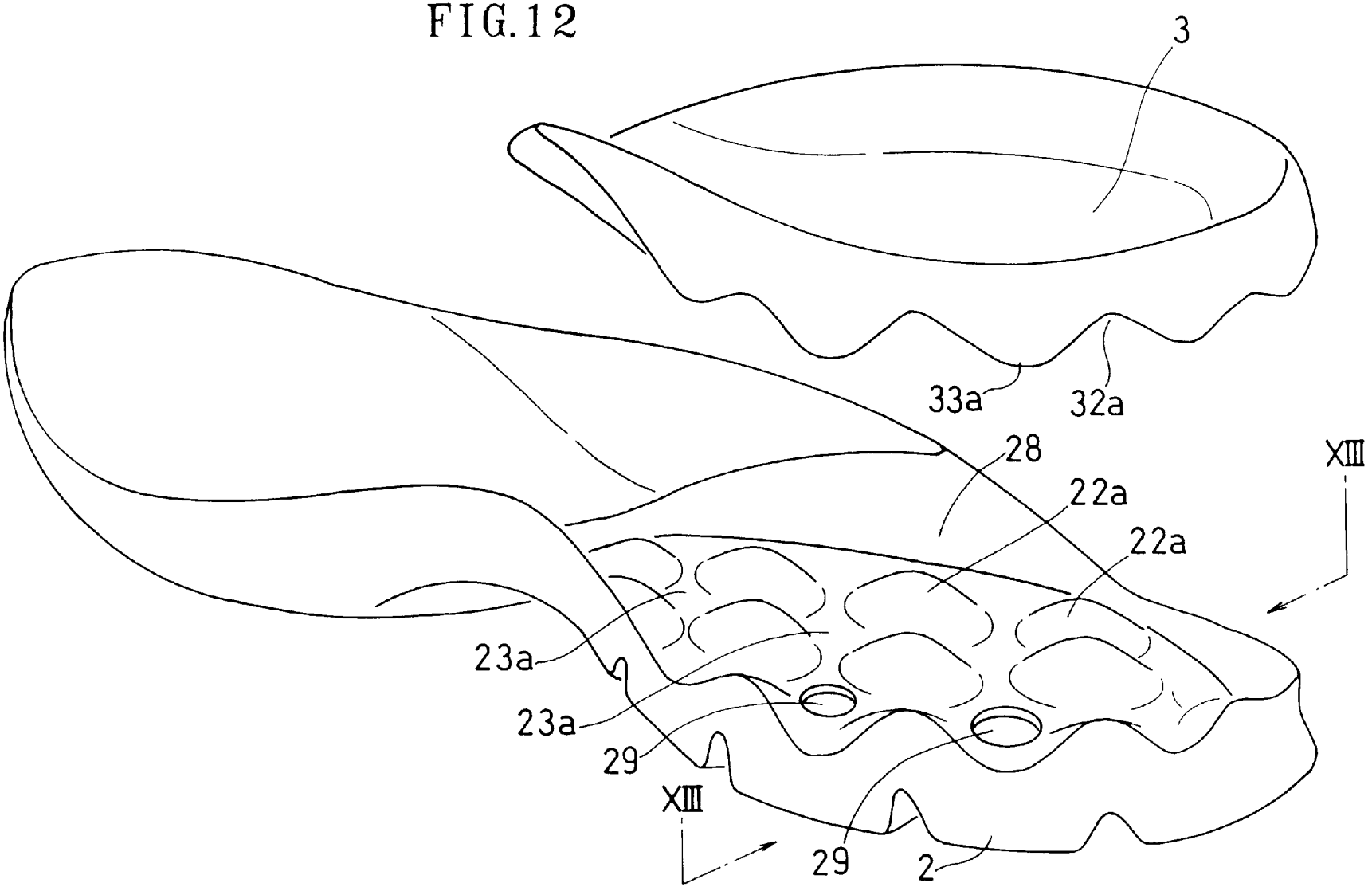
FIG. 12 is an exploded perspective view of a midsole showing a specific fourth embodiment.

Referring to FIG. 12, in this embodiment, the upper layer 3 is formed of the upper midsole body whereas the lower layer 2 is formed of the lower midsole body.

Figure 13:
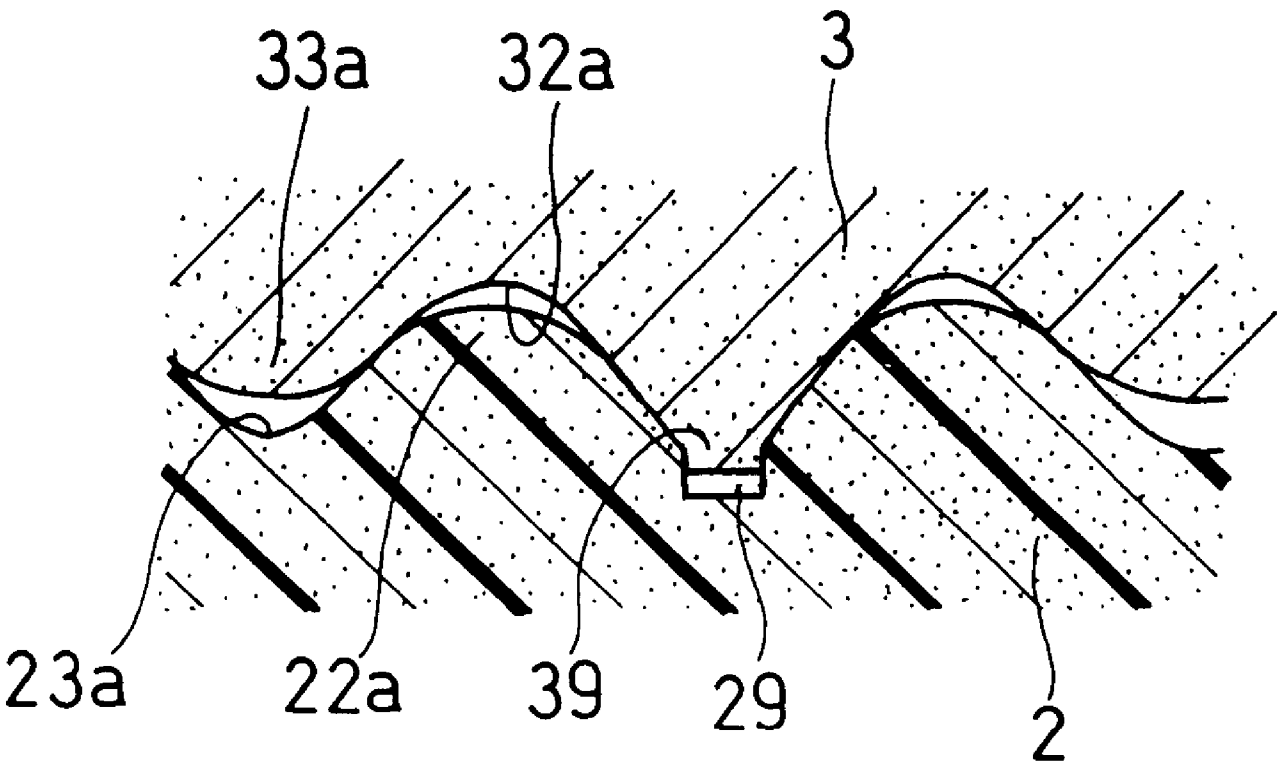
FIG. 13 is a sectional view taken along a line XIII—XIII of FIG. 12.
Figure 14:
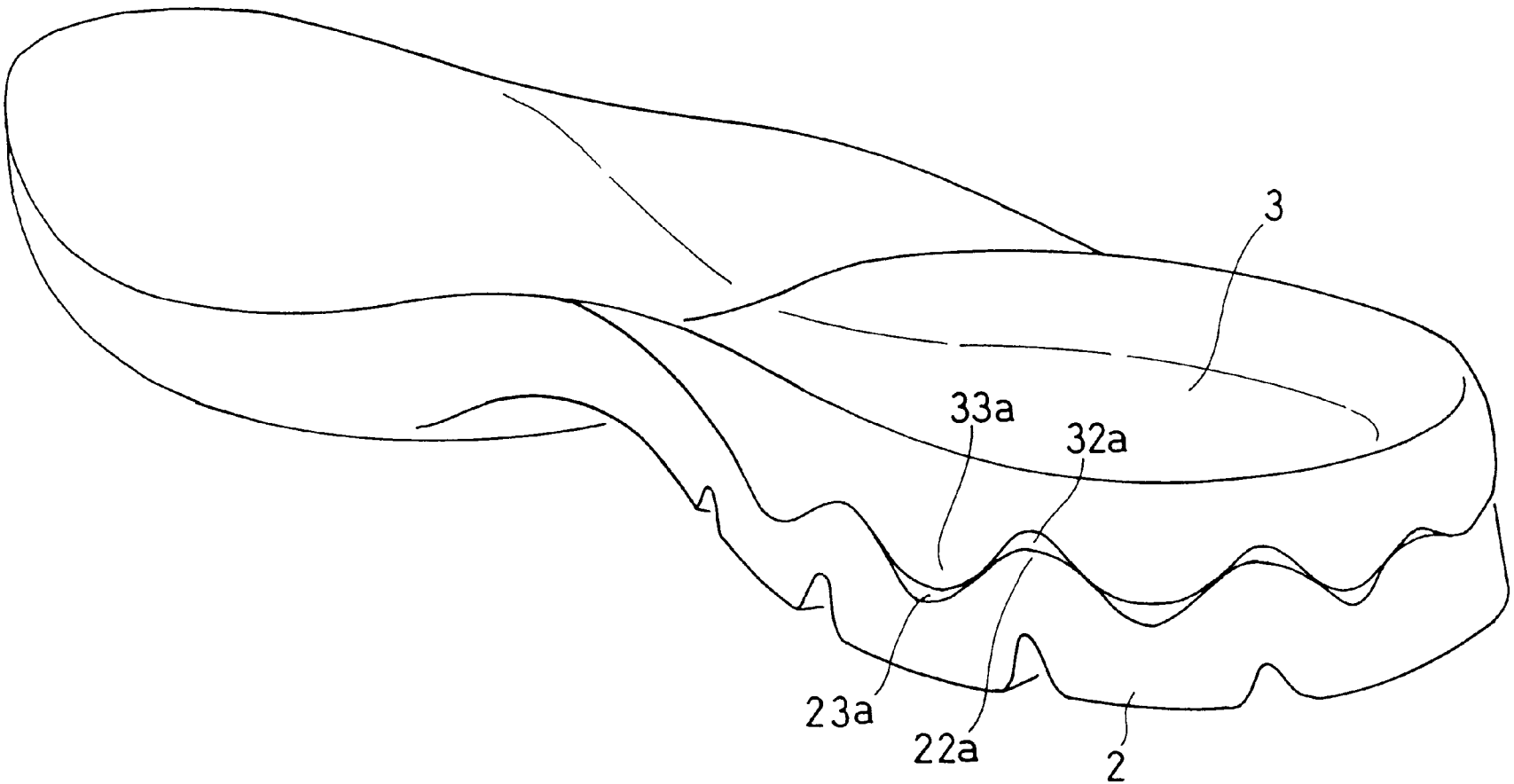
FIG. 14 is a perspective view showing the midsole of FIG. 12 put together.

The lower midsole body 2 is provided with fitting holes (openings) 29. As seen in FIG. 13, the upper midsole body 3 has integrally-formed fitting protrusions 39 which fit in the fitting holes 29. The upper midsole body 3 provides the midsole of FIG. 14 by allowing the fitting protrusions 39 to fit in the fitting holes 29 of FIG. 12 and by being joined at an edge 28 to the lower midsole body 2.

In this embodiment, the lower midsole body 2 is provided with a plurality of fitting holes 29. However, the fitting holes 29 are not provided for each of the troughs 23*a*, i.e. there remain a plurality of troughs 23*a* having no fitting holes 29, at which portions the continuity of the shearing transformation will not be impaired, thus achieving high cushioning properties.

Specific Fifth Embodiment

Figure 15:
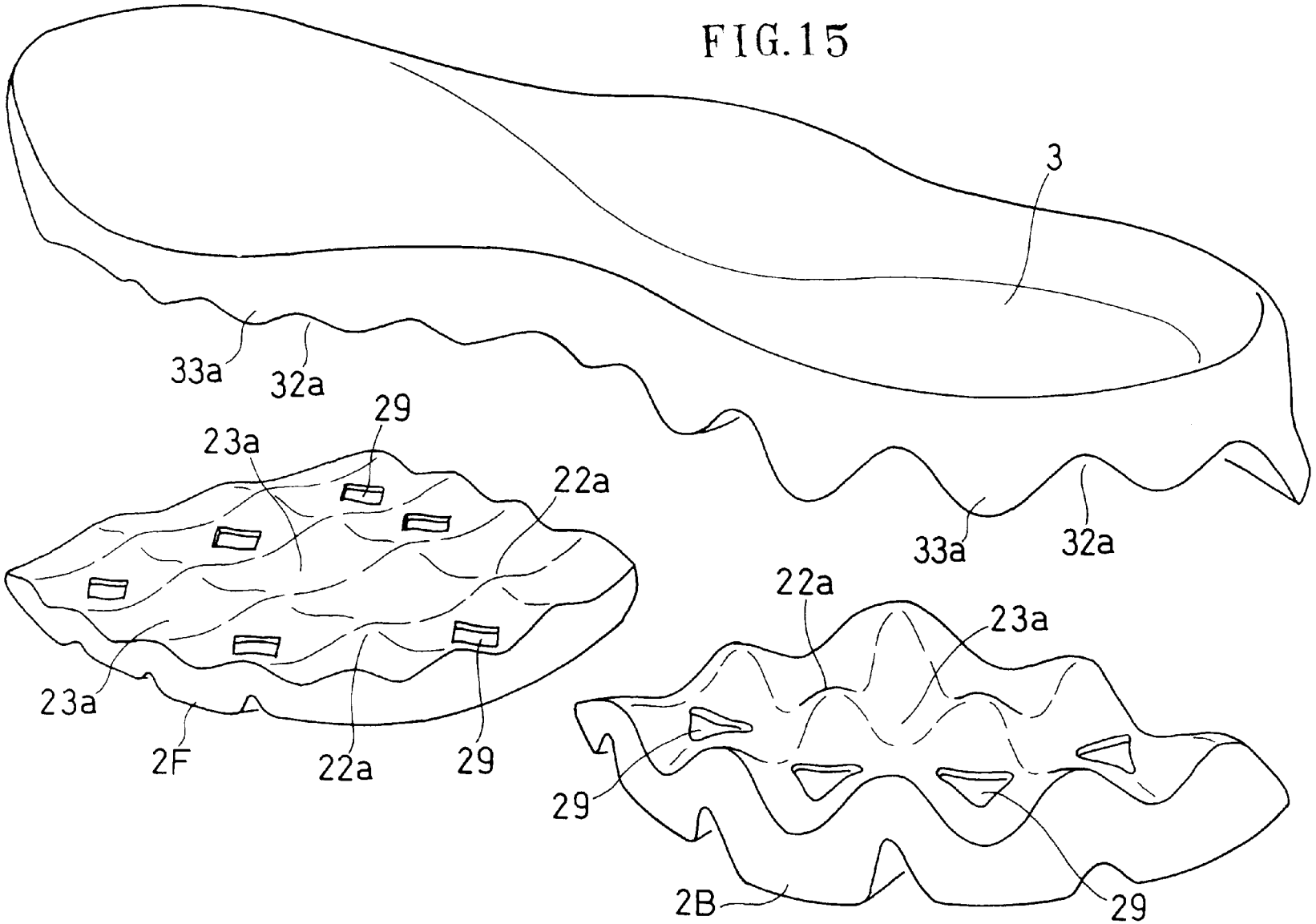
FIG. 15 is an exploded perspective view of a midsole showing a specific fifth embodiment.
Figure 16:
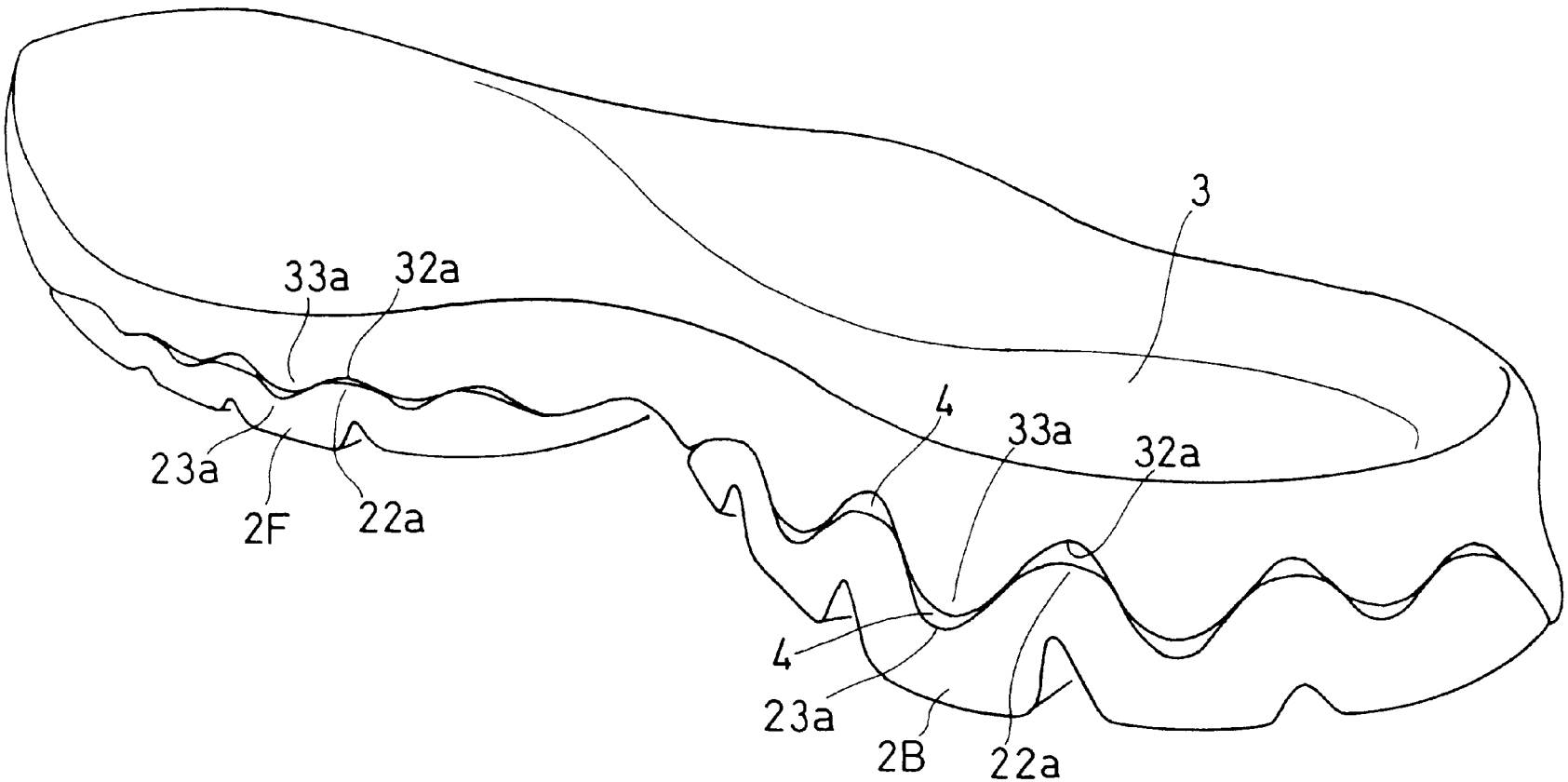
FIG. 16 is a perspective view showing the midsole of FIG. 15 put together.
Figure 17A:
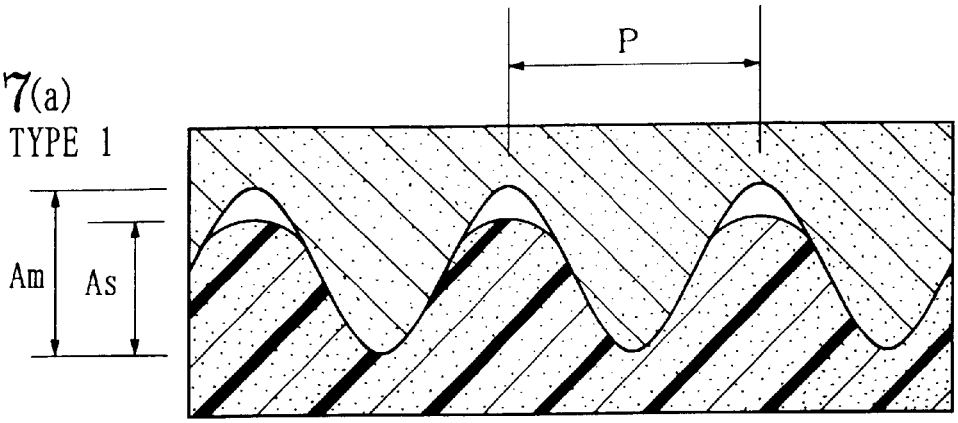
FIGS. 17(*a*) to 17(*d*) are diagrammatic sectional views each showing a model of simulation.
Figure 17B:
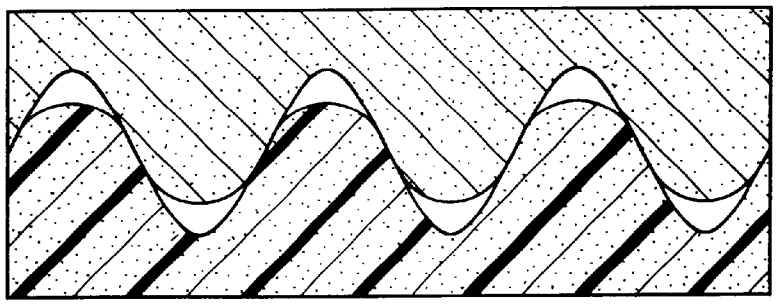
Figure 17C:
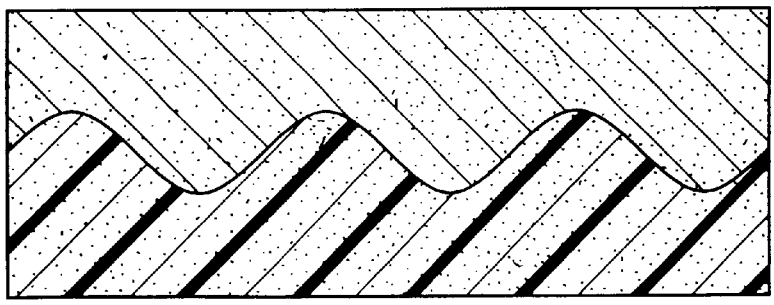
Figure 17D:
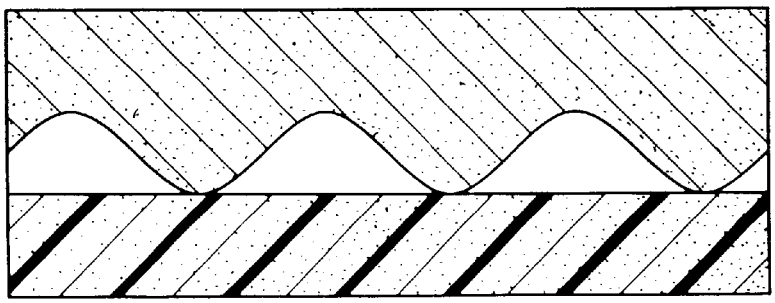

Referring to FIG. 15, in this embodiment, the upper layer 3 is formed of the upper midsole body, whereas the lower layer 2 is formed of the front and rear lower midsole bodies 2F and 2B. Similar to the fourth embodiment, the upper midsole body is joined to the front and rear lower midsole bodies 2F and 2B to make up the midsole depicted in FIG. 16.

To make the effects of the invention clear, the results of simulation (computer-implemented calculation) associated with the present invention are shown as follows.

First, assumption was made of models shown in FIGS. 17(*a*) to 17(*d*). For types 1 and 2 showing test examples, seven different amplitude ratios As/Am were set as in Table 1 below. The pitch P was constantly 12 mm.

The corrugations of these models were based on sine curves and, for the types 1 and 2, the corrugated top portions and bottom portions experienced arcuate variations. Rectilinearly parallel array as shown in FIG. 1(*a*) was employed as each the corrugation arrangement. To make the computer-implemented calculations feasible, the corrugations were subjected to straight line approximation. Then, the shock absorbing properties obtained when a weight impacted from above against these models were figured out by simulation. The results are shown in the Table 1 below.

TABLE 1

| | | Am | As | As/Am | P | Cushioning |
|---|---|---|---|---|---|---|
| TYPE 1 | Test Example 1 | 6 | 3 | 0.5 | 12 | 0.0057 |
| | Test Example 2 | 6 | 3.6 | 0.6 | 12 | 0.0067 |
| | Test Example 3 | 6 | 3.9 | 0.65 | 12 | 0.007 |
| | Test Example 4 | 6 | 4.2 | 0.7 | 12 | 0.0069 |
| | Test Example 5 | 6 | 4.5 | 0.75 | 12 | 0.0061 |
| | Test Example 6 | 6 | 4.8 | 0.8 | 12 | 0.0056 |
| | Test Example 7 | 6 | 5.4 | 0.9 | 12 | 0.0045 |
| TYPE 2 | Test Example 11 | 7.8 | 3.9 | 0.5 | 12 | 0.0069 |
| | Test Example 12 | 6.5 | 3.9 | 0.6 | 12 | 0.0076 |
| | Test Example 13 | 6 | 3.9 | 0.65 | 12 | 0.0073 |
| | Test Example 14 | 5.57 | 3.9 | 0.7 | 12 | 0.0071 |
| | Test Example 15 | 5.2 | 3.9 | 0.75 | 12 | 0.0066 |
| | Test Example 16 | 4.875 | 3.9 | 0.8 | 12 | 0.0061 |
| | Test Example 17 | 4.588 | 3.9 | 0.85 | 12 | 0.006 |
| TYPE 3 | comparative Example 1 | 6 | 6 | 1 | 12 | 0.0044 |
| TYPE 4 | comparative Example 2 | 6 | none | 0 | 12 | 0.0060 |

The cushioning in the table represents the quantized damping of the low-frequency components which the human body feels uncomfortable, which quantization is achieved by performing each frequency-based decomposition of shocks which the weight corresponding to the foot undergoes upon the impact of the weight against the models. It has been verified from the comparison with the sensory tests that larger cushioning values indicate higher shock absorbing abilities in the table.

As can be seen from Table 1, the test examples 1 to 7 and 11 to 17 of the present invention are superior in cushioning to the comparative example 1.

On the other hand, the comparative example 2 shows the superiority in cushioning over the test examples 1, 6 and 7 but suffers a remarkable reduction of cushioning through the repeated use due to the excessive compressive transformation of the crests.

As can be understood from Table 1, it is preferred to set the amplitude ratio As/Am to an appropriate value and typically to set the amplitude ratio As/Am to a value of the order of 0.6 to 0.75.

However, in cases where the upper and lower corrugations are formed into the same contours each other and gaps 4 are provided on the upper and lower of the corrugations as shown in FIG. 1(*b*), a high cushioning may be achieved irrespective of setting of the amplitude ratio As/Am to 1.0 or its vicinity. Thus, the present invention does not intend to limit the amplitude ratio As/Am.

Although the preferred embodiments have been set forth with reference to the drawings, it will easily occur to those skilled in the art from this specification that they can variously be changed or modified within the obvious scope.

Figure 18:
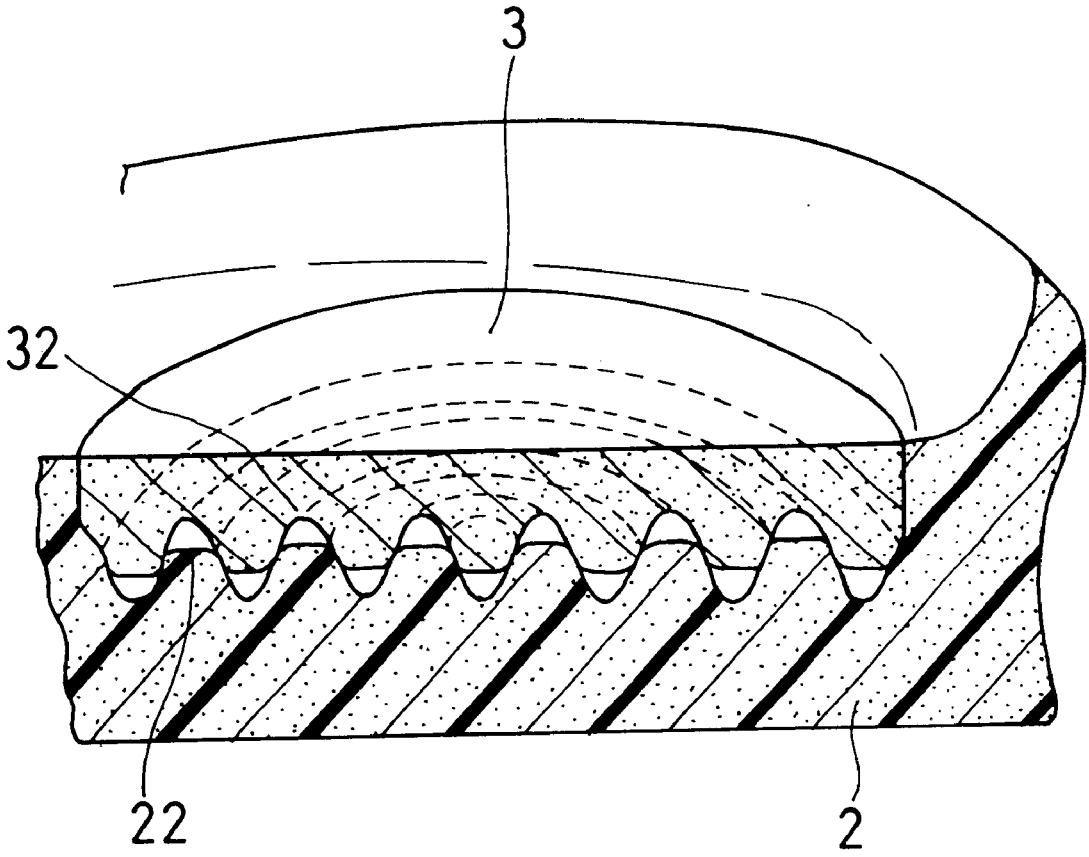
FIG. 18 is a perspective view, partially in section, showing a variant of a corrugation arrangement.
Figure 19A:
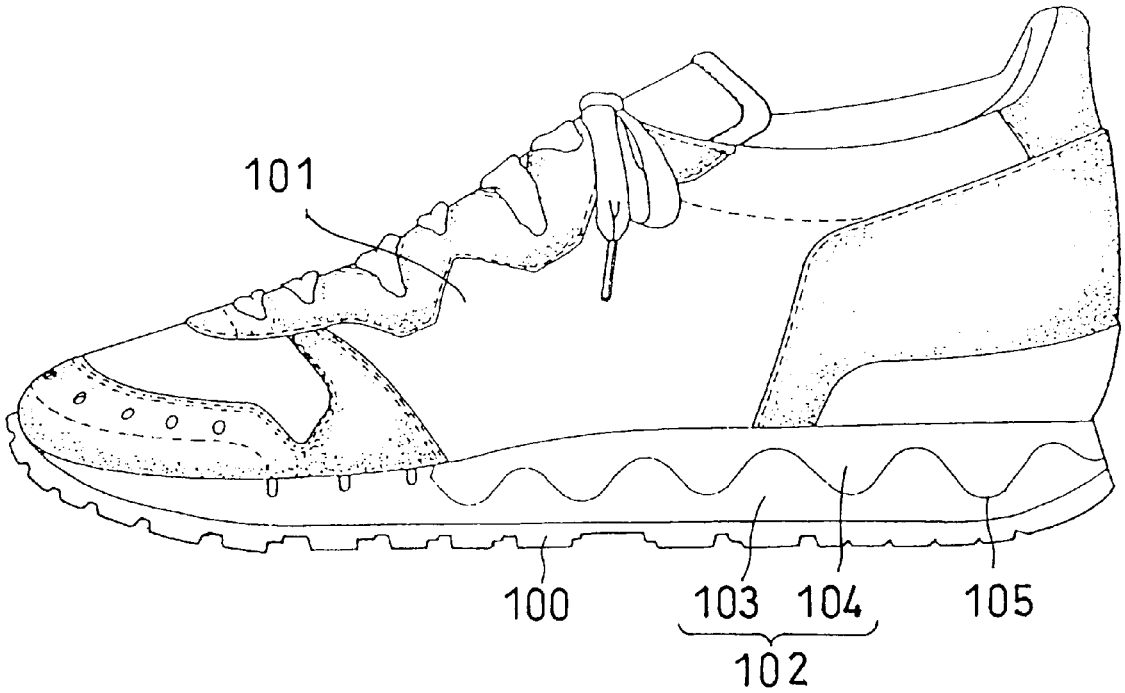
FIG.19(a) PRIOR ART
FIG. 19(*a*) is a side elevational view of a shoe disclosed in U.S. Pat. No. 4,798,010, and FIG. 19(*b*) is a side elevational view, partially in section, of a shock absorbing device for a shoe sole disclosed in Japan Utility Model Laid-open Pub. No. 6-17504.
Figure 19B:
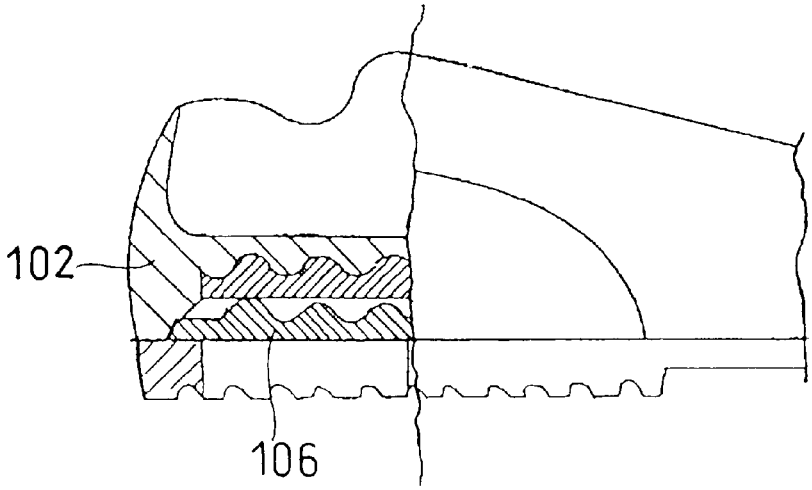
FIG.19(b) PRIOR ART
Figure 20A:
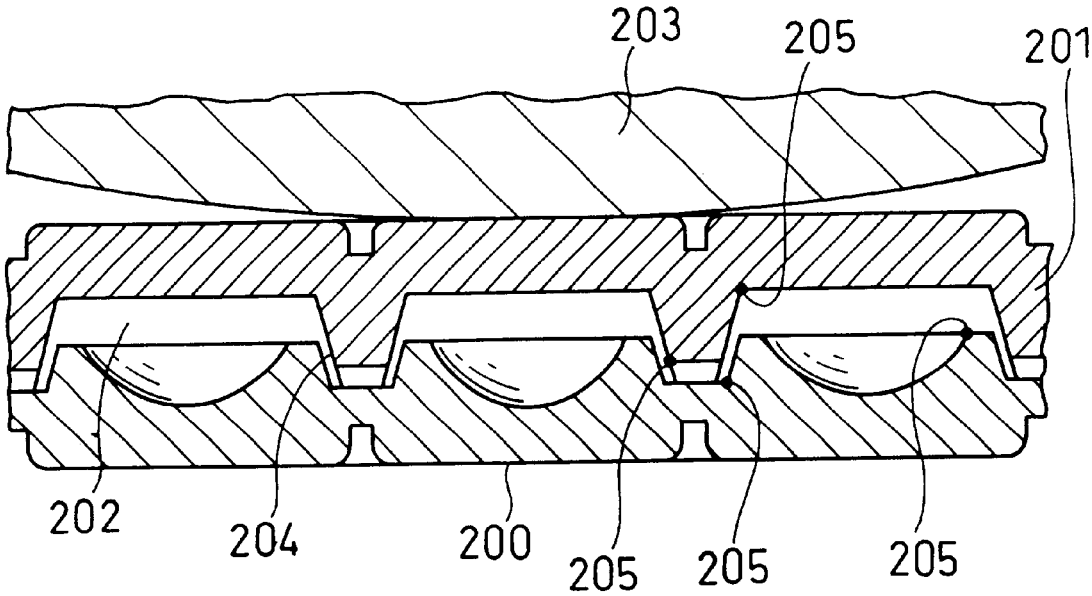
FIG. 20(a) PRIOR ART
FIGS. 20(*a*) and 20(*b*) are sectional views each showing a shock absorbing device for a shoe sole disclosed in U.S. Pat. No. 5,915,819.
Figure 20B:
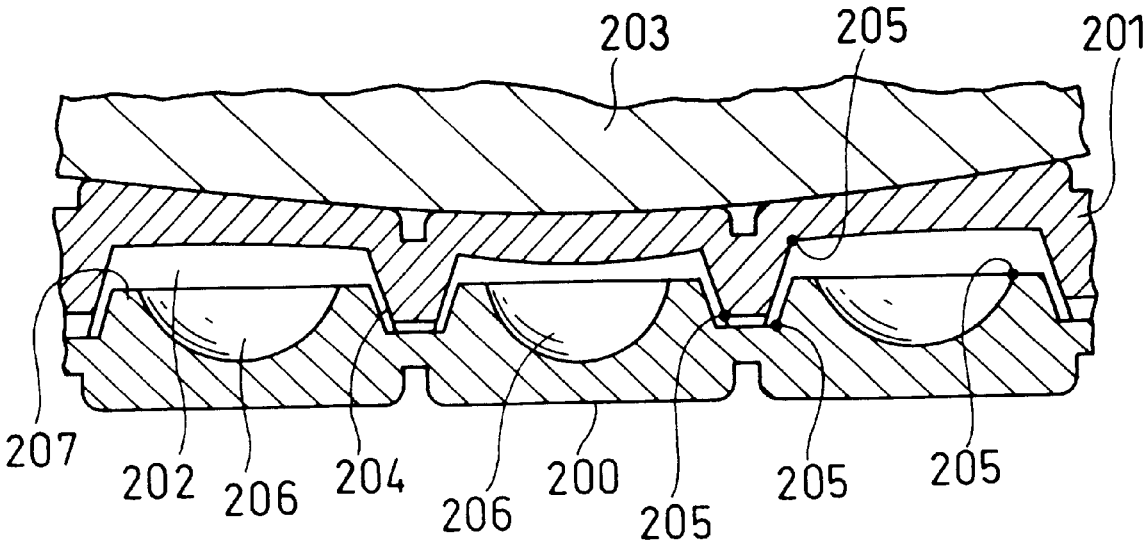
FIG. 20(b) PRIOR ART

For example, as depicted in FIG. 18, the corrugated top portions 22 and 32 (or bottom portions) may concentrically be arranged.

The lower layer may be formed of a silicone gel (low hardness) and the upper layer may be formed of a foam resin (high hardness).

Therefore, such changes and modifications are to be construed as being included within the scope of the invention defined by the appended claims.

What is claimed is:

1. A shock absorbing device for a shoe sole comprising:

a lower layer having an upper face; and an upper layer having a lower face; wherein the two layers are both made of an elastomer, the upper face of the lower layer and the lower face of the upper layer are each substantially corrugated in their sectional configurations, the faces each have a plurality of top portions, a plurality of bottom portions, and a plurality of inclined portions joining the top portions and bottom portions, with the faces each being formed from essentially a smooth and continuous curvilinear surface, the upper face and lower face mate with each other, the two faces are in contact with each other at the inclined portions of the faces, the two faces are spaced apart from each other via spaced-apart portions defined by the two faces at least at either the top portions or the bottom portions, with gaps being formed at the spaced-apart portions.

2. The shock absorbing device for a shoe sole according to claim 1, wherein the upper layer and lower layer are each made of a material different from each other by 2 degrees or more in SRIS-C hardness.

3. The shock absorbing device for a shoe sole according to claim 2, wherein one of the upper layer and the lower layer is made of a foam material of one selected from a group consisting of resin and rubber, and wherein the other layer of the upper layer and the lower layer is made of a gel material.

4. The shock absorbing device for a shoe sole according to claim 2, wherein one of the two layers is set to 40 degrees or more in SRIS-C hardness, and wherein the other of the two layers is set to 35 degrees or less in SRIS-C hardness.

5. The shock absorbing device for a shoe sole according to claim 1, wherein the shoe sole includes a loading depression, a surface of the loading depression providing the upper face of the lower layer, and wherein a member making up the upper layer is loaded into the loading depression.

6. The shock absorbing device for a shoe sole according to claim 5, wherein the shock absorbing device further comprising:

a cap disposed on the upper layer, the cap plugging up the loading depression.

7. The shock absorbing device for a shoe sole according to claim 1, wherein the shock absorbing device comprises a midsole of the shoe sole, the midsole having the upper layer and the lower layer.

8. The shock absorbing device for a shoe sole according to claim 1, wherein the lower face of the upper layer and the upper face of the lower layer are each corrugated not only in one section but also in another section in a direction crossing the one section.

9. The shock absorbing device for a shoe sole according to claim 8, wherein the upper layer and the lower layer each include at least four crests arranged in lattice points of a substantially plane lattice, and wherein the upper layer and the lower layer each include at least four troughs arranged in lattice points of a substantially plane lattice, and wherein each crest of one of the layers fits in each trough of the other of the layers.

10. The shock absorbing device for a shoe sole according to claim 1, wherein the two faces are spaced apart from each other via the spaced-apart portions defined by the two faces both at the top portions and the bottom portions, with gaps being formed at the spaced-apart portions.

11. A shock absorbing device for a shoe sole comprising:

a lower layer having an upper face; and an upper layer having a lower face; wherein the two layers are both made of an elastomer, the upper face of the lower layer and the lower face of the upper layer are each substantially corrugated in their sectional configurations, the faces each have a plurality of top portions, a plurality of bottom portions, and a plurality of inclined portions joining the top portions and bottom portions, the top portions of the upper face of the lower layer are formed with essentially a recess-free, upwardly convexed surface, the bottom portions of the lower face of the upper layer are formed with essentially a recess-free, downwardly convexed surface, the upper face and lower face mate with each other, the two faces are in contact with each other at the inclined portions of the faces, the two faces are spaced apart from each other via spaced-apart portions defined by the two faces at least at either the top portions or the bottom portions, with gaps being formed at the spaced-apart portions.

12. The shock absorbing device for a shoe sole according to claim 11, wherein the upper layer and lower layer are each made of a material different from each other by 2 degrees or more in SRIS-C hardness.

13. The shock absorbing device for a shoe sole according to claim 12, wherein one of the upper layer and the lower layer is made of a foam material of one selected from a group consisting of resin and rubber, and wherein the other layer of the upper layer and the lower layer is made of a gel material.

14. The shock absorbing device for a shoe sole according to claim 12, wherein one of the two layers is set to 40 degrees or more in SRIS-C hardness, and wherein the other of the two layers is set to 35 degrees or less in SRIS-C hardness.

15. The shock absorbing device for a shoe sole according to claim 11, wherein the shoe sole includes a loading depression, a surface of the loading depression providing the upper face of the lower layer, and wherein a member making up the upper layer is loaded into the loading depression.

16. The shock absorbing device for a shoe sole according to claim 15, wherein the shock absorbing device further comprising:

a cap disposed on the upper layer, the cap plugging up the loading depression.

17. The shock absorbing device for a shoe sole according to claim 11, wherein the shock absorbing device comprises a midsole of the shoe sole, the midsole having the upper layer and the lower layer.

18. The shock absorbing device for a shoe sole according to claim 11, wherein the lower face of the upper layer and the upper face of the lower layer are each corrugated not only in one section but also in another section in a direction crossing the one section.

19. The shock absorbing device for a shoe sole according to claim 18, wherein the upper layer and the lower layer each include at least four crests arranged in lattice points of a substantially plane lattice, and wherein the upper layer and the lower layer each include at least four troughs arranged in lattice points of a substantially plane lattice, and wherein each crest of one of the layers fits in each trough of the other of the layers.

20. The shock absorbing device for a shoe sole according to claim 11, wherein the two faces are spaced apart from each other via the spaced-apart portions defined by the two faces both at the top portions and the bottom portions, with gaps being formed at the spaced-apart portions.

* * * * *